US011998975B2

(12) United States Patent
Gill et al.

(10) Patent No.: US 11,998,975 B2
(45) Date of Patent: Jun. 4, 2024

(54) GRAIN REFINING WITH DIRECT VIBRATIONAL COUPLING

(71) Applicant: Southwire Company, LLC, Carrollton, GA (US)

(72) Inventors: Kevin Scott Gill, Carrollton, GA (US); Michael Caleb Powell, Dallas, GA (US); Victor Frederic Rundquist, Carrollton, GA (US); Venkata Kiran Manchiraju, Villa Rica, GA (US); Roland Earl Guffey, Cloverport, KY (US)

(73) Assignee: SOUTHWIRE COMPANY, LLC, Carrollton, GA (US)

( * ) Notice: Subject to any disclaimer, the term of this patent is extended or adjusted under 35 U.S.C. 154(b) by 0 days.

(21) Appl. No.: 17/648,667

(22) Filed: Jan. 22, 2022

(65) Prior Publication Data

US 2022/0250140 A1 Aug. 11, 2022

Related U.S. Application Data

(63) Continuation of application No. 16/492,031, filed as application No. PCT/US2018/021367 on Mar. 7, 2018, now abandoned.

(Continued)

(51) Int. Cl.

| | |
|---|---|
| ***B22D 11/114*** | (2006.01) |
| ***B22D 11/00*** | (2006.01) |
| ***B22D 11/115*** | (2006.01) |

(52) U.S. Cl.

CPC ..... *B22D 11/115* (2013.01); *B22D 11/003* (2013.01)

(58) Field of Classification Search

CPC ..... B22D 11/114; B22D 11/115

See application file for complete search history.

(56) References Cited

U.S. PATENT DOCUMENTS 3,153,820 A * 10/1964 Criner ..... H05B 6/34 164/416

4,582,117 A 4/1986 Kushnick (Continued)

FOREIGN PATENT DOCUMENTS

JP S 52-062130 A 11/1975

JP S 58-6754 1/1983

(Continued)

OTHER PUBLICATIONS

Extended European Search Report and Supplementary European Search Report in EP 18 76 4119 dated Jul. 7, 2020, 10 pages.

(Continued)

*Primary Examiner* — Kevin E Yoon

(74) *Attorney, Agent, or Firm* — Merchant & Gould P.C.

(57) ABSTRACT

A molten metal conveyor having a receptor plate in contact with molten metal during transport of the molten metal. The receptor plate extends from an entrance where molten metal enters onto the receptor plate to an exit where molten metal exits the receptor plate. The molten metal conveyor has at least one vibrational energy source which supplies vibrational energy directly to the receptor plate in contact with molten metal. A corresponding method for forming a metal product includes providing molten metal onto a molten conveyor; cooling the molten metal by control of a cooling medium flowing through a cooling passage in the or attached to the conveyor; and coupling vibrational energy directly into a receptor plate in contact with the molten metal on the conveyor.

17 Claims, 14 Drawing Sheets

Related U.S. Application Data

(60) Provisional application No. 62/468,709, filed on Mar. 8, 2017.

(56) References Cited

U.S. PATENT DOCUMENTS

| | | | |
|---|---|---|---|
| 5,247,954 | A | 9/1993 | Grant et al. |
| 5,355,935 | A | 10/1994 | Nogues |
| 5,520,243 | A | 5/1996 | Freeman et al. |
| 6,044,895 | A | 4/2000 | Kuttner et al. |
| 7,462,960 | B2 | 12/2008 | Or et al. |
| 9,061,928 | B2 | 6/2015 | Boughton et al. |
| 9,481,031 | B2 * | 11/2016 | Han ..... B22D 11/117 |
| 2007/0235159 | A1 | 10/2007 | Han et al. |
| 2011/0030914 | A1 | 2/2011 | Farina |
| 2012/0042751 | A1 | 2/2012 | Rundquist et al. |
| 2016/0228943 | A1 | 11/2016 | Han et al. |
| 2017/0056971 | A1 | 3/2017 | Wang et al. |

FOREIGN PATENT DOCUMENTS

| | | | |
|---|---|---|---|
| JP | S 61-23557 | | 2/1986 |
| JP | 55-045558 | A | 8/2000 |
| JP | 2002-321044 | A | 11/2002 |

OTHER PUBLICATIONS

International Search Report and Written Opinion dated May 24, 2018 in PCT/US18/21367 filed Mar. 7, 2018.

Office Action dated Oct. 15, 2019 in European Patent Application No. 18764119.6.

* cited by examiner

GRAIN REFINING WITH DIRECT VIBRATIONAL COUPLING

CROSS-REFERENCE TO RELATED APPLICATION

This application is a continuation application of U.S. patent application Ser. No. 16/492,031, filed on Sep. 6, 2019, now abandoned, is a National Stage Application of PCT/US2018/021367 filed on Mar. 7, 2018, which claims priority to and the benefit of U.S. Provisional Patent Application No. 62,468,709, filed Mar. 8, 2017, the disclosures of which are incorporated herein by reference in their entirety.

BACKGROUND

This application is related to U.S. Ser. No. 62/372,592 (the entire contents of which are incorporated herein by reference) filed Aug. 9, 2016, entitled ULTRASONIC GRAIN REFINING AND DEGASSING PROCEDURES AND SYSTEMS FOR METAL CASTING. This application is related to U.S. Ser. No. 62/295,333 (the entire contents of which are incorporated herein by reference) filed Feb. 15, 2016, entitled ULTRASONIC GRAIN REFINING AND DEGASSING FOR METAL CASTING. This application is related to U.S. Ser. No. 62/267,507 (the entire contents of which are incorporated herein by reference) filed Dec. 15, 2015, entitled ULTRASONIC GRAIN REFINING AND DEGASSING OF MOLTEN METAL. This application is related to U.S. Ser. No. 62/113,882 (the entire contents of which are incorporated herein by reference) filed Feb. 9, 2015, entitled ULTRASONIC GRAIN REFINING. This application is related to U.S. Ser. No. 62/216,842 (the entire contents of which are incorporated herein by reference) filed Sep. 10, 2015, entitled ULTRASONIC GRAIN REFINING ON A CONTINUOUS CASTING BELT. This application is related to PCT/2016/050978 (the entire contents of which are incorporated herein by reference) filed Sep. 9, 2016, entitled ULTRASONIC GRAIN REFINING AND DEGASSING PROCEDURES AND SYSTEMS FOR METAL CASTING. This application is related to U.S. Ser. No. 15/337,645 (the entire contents of which are incorporated herein by reference) filed Oct. 28, 2016, entitled ULTRASONIC GRAIN REFINING AND DEGASSING PROCEDURES AND SYSTEMS FOR METAL CASTING.

This application is related to U.S. Ser. No. 62/460,287 (the entire contents of which are incorporated herein by reference) filed Feb. 17, 2017, entitled ULTRASONIC GRAIN REFINING AND DEGASSING PROCEDURES AND SYSTEMS FOR METAL CASTING INCLUDING ENHANCED VIBRATIONAL COUPLING.

Field

The present invention is related to a method for producing metal castings with controlled grain size, a system for producing the metal castings, and products obtained by the metal castings.

Description of the Related Art

Considerable effort has been expended in the metallurgical field to develop techniques for casting molten metal into continuous metal rod or cast products. Both batch casting and continuous castings are well developed. There are a number of advantages of continuous casting over batch castings although both are prominently used in the industry.

In the continuous production of metal cast, molten metal passes from a holding furnace into a series of launders and into the mold of a casting wheel where it is cast into a metal bar. The solidified metal bar is removed from the casting wheel and directed into a rolling mill where it is rolled into continuous rod. Depending upon the intended end use of the metal rod product and alloy, the rod may be subjected to cooling during rolling or the rod may be cooled or quenched immediately upon exiting from the rolling mill to impart thereto the desired mechanical and physical properties. Techniques such as those described in U.S. Pat. No. 3,395,560 to Cofer et al. (the entire contents of which are incorporated herein by reference) have been used to continuously-process a metal rod or bar product.

U.S. Pat. No. 3,938,991 to Sperry et al. (the entire contents of which are incorporated herein by reference) shows that there has been a long recognized problem with casting of "pure" metal products. By "pure" metal castings, this term refers to a metal or a metal alloy formed of the primary metallic elements designed for a particular conductivity or tensile strength or ductility without inclusion of separate impurities added for the purpose of grain control.

Grain refining is a process by which the crystal size of the newly formed phase is reduced by either chemical or physical/mechanical means. Grain refiners are usually added into molten metal to significantly reduce the grain size of the solidified structure during the solidification process or the liquid to solid phase transition process.

Indeed, a WIPO Patent Application WO/2003/033750 to Boily et al. (the entire contents of which are incorporated herein by reference) describes the specific use of "grain refiners." The '750 application describes in their background section that, in the aluminum industry, different grain refiners are generally incorporated in the aluminum to form a master alloy. A typical master alloys for use in aluminum casting comprise from 1 to 10% titanium and from 0.1 to 5% boron or carbon, the balance consisting essentially of aluminum or magnesium, with particles of $TiB_2$ or TiC being dispersed throughout the matrix of aluminum. According to the '750 application, master alloys containing titanium and boron can be produced by dissolving the required quantities of titanium and boron in an aluminum melt. This is achieved by reacting molten aluminum with $KBF_4$ and $K_2TiF_6$ at temperatures in excess of 800° C. These complex halide salts react quickly with molten aluminum and provide titanium and boron to the melt.

The '750 application also describes that, as of 2002, this technique was used to produce commercial master alloys by almost all grain refiner manufacturing companies. Grain refiners frequently referred to as nucleating agents are still used today. For example, one commercial supplier of a TIBOR master alloy describes that the close control of the cast structure is a major requirement in the production of high quality aluminum alloy products.

Prior to this invention, grain refiners were recognized as the most effective way to provide a fine and uniform as-cast grain structure. The following references (all the contents of which are incorporated herein by reference) provide details of this background work:

Abramov, O. V., (1998), "*High-Intensity Ultrasonics*," Gordon and Breach Science Publishers, Amsterdam, The Netherlands, pp. 523-552.

Alcoa, (2000), "*New Process for Grain Refinement of Aluminum*," DOE Project Final Report, Contract No. DE-FC07-98ID13665, Sep. 22, 2000.

Cui, Y., Xu, C. L. and Han, Q., (2007), "*Microstructure Improvement in Weld Metal Using Ultrasonic Vibrations, Advanced Engineering Materials*," v. 9, No. 3, pp. 161-163.

Eskin, G. I., (1998), "*Ultrasonic Treatment of Light Alloy Melts*," Gordon and Breach Science Publishers, Amsterdam, The Netherlands.

Eskin, G. I. (2002) "*Effect of Ultrasonic Cavitation Treatment of the Melt on the Microstructure Evolution during Solidification of Aluminum Alloy Ingots," Zeitschrift Fur Metallkunde/Materials Research and Advanced Techniques,* v. 93, n. 6, June, 2002, pp. 502-507.

Greer, A. L., (2004), "*Grain Refinement of Aluminum Alloys*," in Chu, M. G., Granger, D. A., and Han, Q., (eds.), "*Solidification of Aluminum Alloys*," Proceedings of a Symposium Sponsored by TMS (The Minerals, Metals & Materials Society), TMS, Warrendale, PA 15086-7528, pp. 131-145.

Han, Q., (2007), *The Use of Power Ultrasound for Material Processing*," Han, Q., Ludtka, G., and Zhai, Q., (eds), (2007), "*Materials Processing under the Influence of External Fields," Proceedings of a Symposium* Sponsored by TMS (The Minerals, Metals & Materials Society), TMS, Warrendale, PA 15086-7528, pp. 97-106.

Jackson, K. A., Hunt, J. D., and Uhlmann, D. R., and Seward, T. P., (1966), "*On Origin of Equiaxed Zone in Castings*," Trans. Metall. Soc. AIME, v. 236, pp. 149-158.

Jian, X., Xu, H., Meek, T. T., and Han, Q., (2005), "*Effect of Power Ultrasound on Solidification of Aluminum A356 Alloy," Materials Letters*, v. 59, no. 2-3, pp. 190-193.

Keles, O. and Dundar, M., (2007). "*Aluminum Foil: Its Typical Quality Problems and Their Causes," Journal of Materials Processing Technology*, v. 186, pp. 125-137.

Liu, C., Pan, Y., and Aoyama, S., (1998), *Proceedings of the 5th International Conference on Semi-Solid Processing of Alloys and Composites*, Eds.: Bhasin, A. K., Moore, J. J., Young, K. P., and Madison, S., Colorado School of Mines, Golden, CO, pp. 439-447.

Megy, J., (1999), "Molten Metal Treatment," U.S. Pat. No. 5,935,295, August, 1999

Megy, J., Granger, D. A., Sigworth, G. K., and Durst, C. R., (2000), "*Effectiveness of In-Situ Aluminum Grain Refining Process," Light Metals,* pp. 1-6.

Cui et al., "*Microstructure Improvement in Weld Metal Using Ultrasonic Vibrations," Advanced Engineering Materials,* 2007, vol. 9, no. 3, pp. 161-163.

Han et al., "*Grain Refining of Pure Aluminum," Light Metals* 2012, pp. 967-971.

Prior to this invention, U.S. Pat. Nos. 8,574,336 and 8,652,397 (the entire contents of each patent are incorporated herein by reference) described methods for reducing the amount of a dissolved gas (and/or various impurities) in a molten metal bath (e.g., ultrasonic degassing) for example by introducing a purging gas into the molten metal bath in close proximity to the ultrasonic device. These patents will be referred to hereinafter as the '336 patent and the '397 patent.

SUMMARY

In one embodiment of the present invention, there is provided a molten metal conveyor having a receptor plate in contact with molten metal during transport of the molten metal. The receptor plate extends from an entrance where molten metal enters onto the receptor plate to an exit where molten metal exits the receptor plate. The molten metal conveyor has at least one vibrational energy source which supplies vibrational energy directly to the receptor plate in contact with molten metal.

In one embodiment of the present invention, there is provided a method for forming a metal product includes providing molten metal onto a molten conveyor; cooling the molten metal by control of a cooling medium flowing through a cooling passage in the or attached to the conveyor; and coupling vibrational energy directly into a receptor plate in contact with the molten metal on the conveyor.

It is to be understood that both the foregoing general description of the invention and the following detailed description are exemplary, but are not restrictive of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
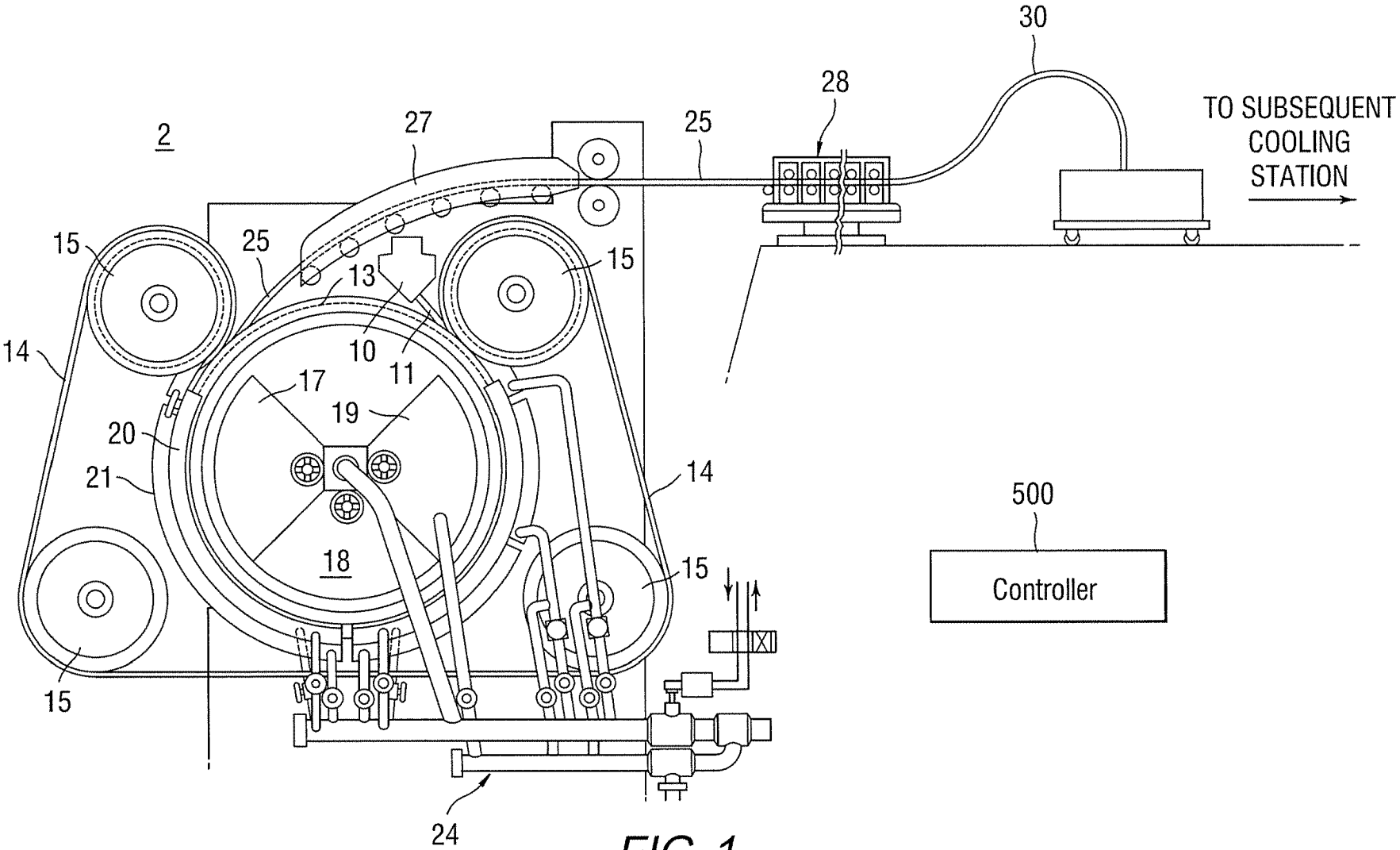
FIG. 1 is a schematic of a continuous casting mill according to one embodiment of the invention.

Grain refining of metals and alloys is important for many reasons, including maximizing ingot casting rate, improving resistance to hot tearing, minimizing elemental segregation, enhancing mechanical properties, particularly ductility, improving the finishing characteristics of wrought products and increasing the mold filling characteristics, and decreasing the porosity of foundry alloys. Usually grain refining is one of the first processing steps for the production of metal and alloy products, especially aluminum alloys and magnesium alloys, which are two of the lightweight materials used increasingly in the aerospace, defense, automotive, construction, and packaging industry. Grain refining is also an important processing step for making metals and alloys castable by eliminating columnar grains and forming equiaxed grains.

Grain refining is a solidification processing step by which the crystal size of the solid phases is reduced by either chemical, physical, or mechanical means in order to make alloys castable and to reduce defect formation. Currently, aluminum production is grain refined using TIBOR, resulting in the formation of an equiaxed grain structure in the solidified aluminum. Prior to this invention, use of impurities or chemical "grain refiners" was the only way to address the long recognized problem in the metal casting industry of columnar grain formation in metal castings. Additionally, prior to this invention, a combination of 1) ultrasonic degassing to remove impurities from the molten metal (prior to casting) along and 2) the above-noted ultrasonic grain refining (i.e., at least one vibrational energy source) had not been undertaken.

However, there are large costs associated with using TIBOR and mechanical restraints due to the input of those inoculants into the melt. Some of the restraints include ductility, machinability, and electrical conductivity.

Despite the cost, approximately 68% of the aluminum produced in the United States is first cast into ingot prior to further processing into sheets, plates, extrusions, or foil. The direct chill (DC) semi-continuous casting process and continuous casting (CC) process has been the mainstay of the aluminum industry due largely to its robust nature and relative simplicity. One issue with the DC and CC processes is the hot tearing formation or cracking formation during ingot solidification. Basically, almost all ingots would be cracked (or not castable) without using grain refining.

Still, the production rates of these modern processes are limited by the conditions to avoid cracking formation. Grain refining is an effective way to reduce the hot tearing tendency of an alloy, and thus to increase the production rates. As a result, a significant amount of effort has been concentrated on the development of powerful grain refiners that can produce grain sizes as small as possible. Superplasticity can be achieved if the grain size can be reduced to the submicron level, which permits alloys not only to be cast at much faster rates but also rolled/extruded at lower temperatures at much faster rates than ingots are processed today, leading to significant cost savings and energy savings.

At present, nearly all aluminum cast in the world either from primary (approximately 20 billion kg) or secondary and internal scrap (25 billion kg) is grain refined with heterogeneous nuclei of insoluble $TiB_2$ nuclei approximately a few microns in diameter, which nucleate a fine grain structure in aluminum. One issue related to the use of chemical grain refiners is the limited grain refining capability. Indeed, the use of chemical grain refiners causes a limited decrease in aluminum grain size, from a columnar structure with linear grain dimensions of something over 2,500 μm, to equiaxed grains of less than 200 μm. Equiaxed grains of 100 μm in aluminum alloys appear to be the limit that can be obtained using the chemical grain refiners commercially available.

The productivity can be significantly increased if the grain size can be further reduced. Grain size in the sub-micron level leads to superplasticity that makes forming of aluminum alloys much easier at room temperatures.

Another issue related to the use of chemical grain refiners is the defect formation associated with the use of grain refiners. Although considered in the prior art to be necessary for grain refining, the insoluble, foreign particles are otherwise undesirable in aluminum, particularly in the form of particle agglomerates ("clusters"). The current grain refiners, which are present in the form of compounds in aluminum base master alloys, are produced by a complicated string of mining, beneficiation, and manufacturing processes. The master alloys used now frequently contain potassium aluminum fluoride (KAlF) salt and aluminum oxide impurities (dross) which arise from the conventional manufacturing process of aluminum grain refiners. These give rise to local defects in aluminum (e.g. "leakers" in beverage cans and "pin holes" in thin foil), machine tool abrasion, and surface finish problems in aluminum. Data from one of the aluminum cable companies indicate that 25% of the production defects is due to $TiB_2$ particle agglomerates, and another 25% of defects is due to dross that is entrapped into aluminum during the casting process. $TiB_2$ particle agglomerates often break the wires during extrusion, especially when the diameter of the wires is smaller than 8 mm.

Another issue related to the use of chemical grain refiners is the cost of the grain refiners. This is extremely true for the production of magnesium ingots using Zr grain refiners. Grain refining using Zr grain refiners costs about an extra $1 per kilogram of Mg casting produced. Grain refiners for aluminum alloys cost around $1.50 per kilogram.

Another issue related to the use of chemical grain refiners is the reduced electrical conductivity. The use of chemical grain refiners introduces in excess amount of Ti in aluminum, causes a substantial decrease in electrical conductivity of pure aluminum for cable applications. In order to maintain certain conductivity, companies have to pay extra money to use purer aluminum for making cables and wires.

A number of other grain refining methods, in addition to the chemical methods, have been explored in the past century. These methods include using physical fields, such as magnetic and electro-magnetic fields, and using mechanical vibrations. High-intensity, low-amplitude ultrasonic vibration is one of the physical/mechanical mechanisms that has been demonstrated for grain refining of metals and alloys without using foreign particles. However, experimental results, such as from Cui et al, 2007 noted above, were obtained in small ingots up to a few pounds of metal subjected to a short period of time of ultrasonic vibration. Little effort has been carried out on grain refining of CC or DC casting ingots/billets using high-intensity ultrasonic vibrations.

As used herein, embodiments of the present invention will be described using terminologies commonly employed by those skilled in the art to present their work. These terms are to be accorded the common meaning as understood by those of the ordinary skill in the arts of materials science, metallurgy, metal casting, and metal processing. Some terms taking a more specialized meaning are described in the embodiments below. Nevertheless, the term "configured to" is understood herein to depict appropriate structures (illustrated herein or known or implicit from the art) permitting an object thereof to perform the function which follows the "configured to" term. The term "coupled to" means that one object coupled to a second object has the necessary structures to support the first object in a position relative to the second object (for example, abutting, attached, displaced a predetermined distance from, adjacent, contiguous, joined together, detachable from one another, dismountable from each other, fixed together, in sliding contact, in rolling contact) with or without direct attachment of the first and second objects together.

U.S. Pat. No. 4,066,475 to Chia et al. (the entire contents of which are incorporated herein by reference) describes a continuous casting process. In general, FIG. 1 depicts continuous casting system having a casting mill 2 having a delivery device 10 (such as tundish) which provides molten metal to a pouring spout 11 which directs the molten metal to a peripheral groove contained on a rotary mold ring 13. An endless flexible metal band 14 encircles both a portion of the mold ring 13 as well as a portion of a set of band-positioning rollers 15 such that a continuous casting mold is defined by the groove in the mold ring 13 and the overlying metal band 14. A cooling system is provided for cooling the apparatus and effecting controlled solidification of the molten metal during its transport on the rotary mold ring 13. The cooling system includes a plurality of side headers 17, 18, and 19 disposed on the side of the mold ring 13 and inner and outer band headers 20 and 21, respectively, disposed on the inner and outer sides of the metal band 14 at a location where it encircles the mold ring. A conduit network 24 having suitable valving is connected to supply and exhaust coolant to the various headers so as to control the cooling of the apparatus and the rate of solidification of the molten metal.

By such a construction, molten metal is fed from the pouring spout 11 into the casting mold and is solidified and partially cooled during its transport by circulation of coolant through the cooling system. A solid cast bar 25 is withdrawn from the casting wheel and fed to a conveyor 27 which conveys the cast bar to a rolling mill 28. It should be noted that the cast bar 25 has only been cooled an amount sufficient to solidify the bar, and the bar remains at an elevated temperature to allow an immediate rolling operation to be performed thereon. The rolling mill 28 can include a tandem array of rolling stands which successively roll the bar into a continuous length of wire rod 30 which has a substantially uniform, circular cross-section.

FIG. 1 shows controller 500 which controls the various parts of the continuous casting system shown therein, as discussed in more detail below. Controller 500 may include one or more processors with programmed instructions (i.e., algorithms) to control the operation of the continuously casting system and the components thereof.

U.S. Pat. No. 9,481,031 to Han et al. (the entire contents of which are incorporated herein by reference) describes a molten metal processing device including a molten metal containment structure for reception and transport of molten metal along a longitudinal length thereof. The device further included a cooling unit for the containment structure including a cooling channel for passage of a liquid medium therein, and an ultrasonic probe disposed in relation to the cooling channel such that ultrasonic waves are coupled through the liquid medium in the cooling channel and through the molten metal containment structure into the molten metal.

As described in the '031 patent, an ultrasonic wave probe provided ultrasonic vibrations (UV) through the liquid medium and through a bottom plate of a molten metal containment structure into which liquid metal was supplied. In the '031 patent, the ultrasonic wave probe was shown inserted into the liquid medium passage. As described in the '031 patent, a relatively small amount of undercooling (e.g., less than 10° C.) at the bottom of the channel results in a layer of small nuclei of purer aluminum being formed. The ultrasonic vibrations from the bottom of the channel creates pure aluminum nuclei which then are used as nucleating agents during solidification resulting in a uniform grain structure. As described in the '031 patent, the ultrasonic vibrations from the bottom of the channel disperse these nuclei and breaks up dendrites that forms in the undercooled layer. These aluminum nuclei and fragments of dendrites are then used to form equiaxed grains in the mold during solidification resulting in a uniform grain structure.

In one embodiment of the present invention, ultrasonic grain refining involves application of ultrasonic energy (and/or other vibrational energy) for the refinement of the grain size. While the invention is not bound to any particular theory, one theory is that the injection of vibrational energy (e.g., ultrasonic power) into a molten or solidifying alloy can give rise to nonlinear effects such as cavitation, acoustic streaming, and radiation pressure. These nonlinear effects can be used to nucleate new grains, and break up dendrites during solidification process of an alloy.

Under this theory, the grain refining process can be divided into two stages: 1) nucleation and 2) growth of the newly formed solid from the liquid. Spherical nuclei are formed during the nucleation stage. These nuclei develop into dendrites during the growth stage. Unidirectional growth of dendrites leads to the formation of columnar grains potentially causing hot tearing/cracking and non-uniform distribution of the secondary phases. This in turn can lead to poor castability. On the other hand, uniform growth of dendrites in all directions (such as possible with the present invention) leads to the formation of equiaxed grains. Castings/ingots containing small and equiaxed grains have excellent formability.

Under this theory, when the temperature in an alloy is below the liquidus temperature; nucleation may occur when the size of the solid embryos is larger than a critical size given in the following equation:

$$r^* = \frac{2\sigma_{sl}}{\Delta G_V}$$

where r* is the critical size, $\sigma_{sl}$ is the interfacial energy associated with the solid-liquid interface, and $\Delta G_V$ is the Gibbs free energy associated with the transformation of a unit volume of liquid into solid.

Under this theory, the Gibbs free energy, $\Delta G$, decreases with increasing size of the solid embryos when their sizes are larger than r*, indicating the growth of the solid embryo is thermodynamically favorable. Under such conditions, the solid embryos become stable nuclei. However, homogeneous nucleation of solid phase having size greater than r* occurs only under extreme conditions that require large undercooling in the melt.

Under this theory, the nuclei formed during solidification can grow into solid grains known as dendrites. The dendrites can also be broken into multiple small fragments by application of the vibrational energy. The dendritic fragments thus formed can grow into new grains and result in the formation of small grains; thus creating an equiaxed grain structure.

In other words, ultrasonic vibrations transmitted into the undercooled liquid metal create nucleation sites in the metals or metallic alloys to refine the grain size. The nucleation sites can be generated via the vibrational energy acting as described above to break up the dendrites creating in the molten metal numerous nuclei which are not dependent on foreign impurities.

Here, in one embodiment of the invention, an ultrasonic device is not configured to have ultrasonic waves exclusively coupled through a liquid medium in a cooling channel and then through a bottom plate of a molten metal containment structure into the molten metal. Instead, in this embodiment, ultrasonic waves are directly coupled to a plate or receptor in contact with molten metal.

Figure 2:
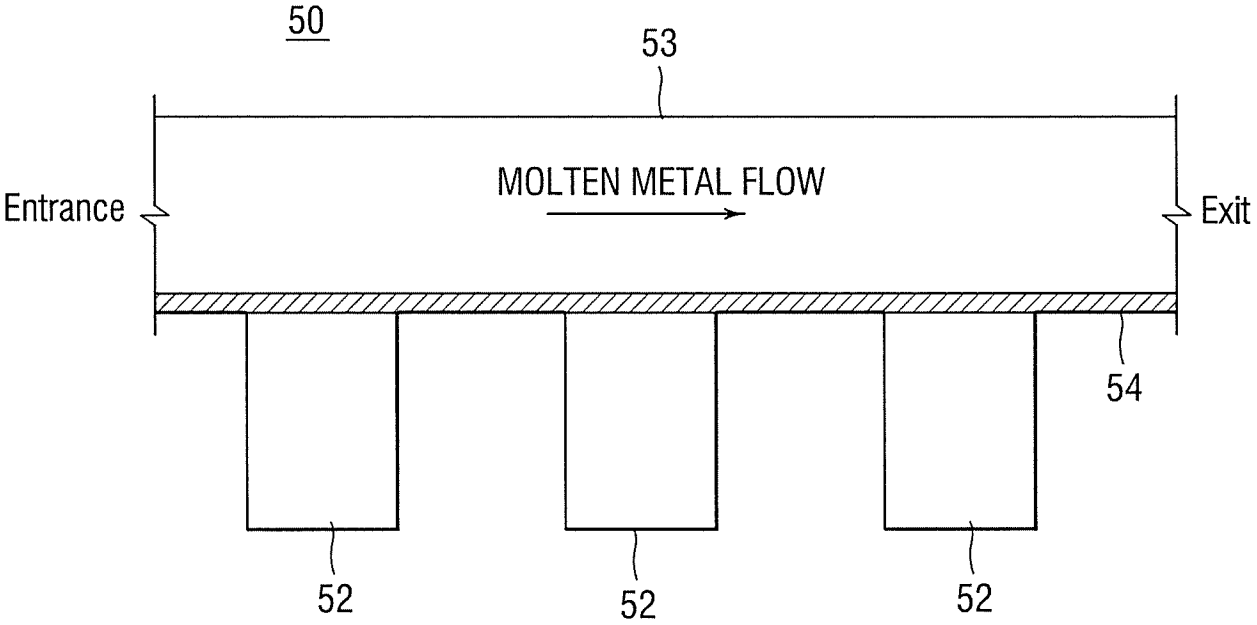
FIG. 2 is a schematic of a molten metal conveyor having multiple magnetostrictive transducers attached along a longitudinal length of a vibratory plate.

One or more magnetostrictive ultrasonic devices may be attached directly to the plate or receptor in contact with molten metal during transport of the molten metal. The receptor plate may extend longitudinally from an entrance where molten metal enters onto the receptor plate to an exit where molten metal exits the receptor plate. Indeed, FIG. 2 depicts a molten metal conveyor 50 (sidewalls not shown) having multiple magnetostrictive transducers 52 attached and evenly spaced apart along a longitudinal length of vibratory (ultrasonic) plate 54. The transducers 52 need not be evenly spaced. Furthermore, the transducers can be spaced with a lateral separation in a direction of the width of the plate 54. FIG. 2 depicts the surface of the molten metal above plate 54. The molten metal traveling above plate 54 can be confined in a flow channel of any shape including rectangular, square, or round.

In one embodiment of the invention, the thickness of the molten metal traveling above plate 54 is less than 10 centimeters thick in one embodiment. In this embodiment, the thickness of the molten metal can be less than 1 centimeter. Alternatively, the thickness of the molten metal can be less than a half of a centimeter.

Accordingly, the receptor plate 54 can have a lateral width equal to or less than a longitudinal length, or the lateral width can be equal to or less than a half of the longitudinal length; or the lateral width can be equal to or less than a third of the longitudinal length. For example, the receptor plate 54 can have a lateral width between 2.5 cm and 300 cm. The length of the receptor plate 54 can be between 2.5 cm to 300 cm. Moreover, the receptor plate 54 can have a lateral width which tapers down in width toward the exit. The dimensions of the receptor plate 54 in one embodiment can vary up to (but not limited to) 220 cm wide and 70 cm long, although other dimensions can be used. The dimensions may be inversed with 220 cm being a length and 70 cm being a width.

Further, the receptor plate 54 can be disposed across a wide range of angular disposition from a near horizontal orientation (within 20 angular degrees) to a near vertical orientation (within 20 angular degrees), with gravity forcing the molten metal to the exit. More specifically, the receptor plate 54 can be disposed within 10 angular degrees (or 5 angular degrees) from a horizontal orientation with gravity forcing the molten metal to the exit. Alternatively, the receptor plate 54 can be disposed within 10 angular degrees (or 5 angular degrees) from a vertical orientation with gravity forcing the molten metal to the exit. The surface of the plate on which the molten metal is conveyed (or flows) can be smooth, polished, rough, raised, indented, and/or textured. Alternatively, the receptor plate 54 can be disposed at any angular position from horizontal (or near horizontal) to vertical (or near vertical). This wide angular range permits molten metal to be conveyed along the receptor plate 54 whether the vibratory plate is applied in a level pour system or a down spout scenario into a casting mold.

In one embodiment of the invention, there is included a controller (e.g., controller 500) controlling at least one of a pour rate of the molten metal onto the receptor plate and/or a cooling rate of the molten metal on the receptor plate. The controller is preferably programmed to adjust the pour rate such that a height of the molten metal above the receptor plate is between 1.25 cm and 10 cm, or between 2.5 cm and 5 cm, or between 3 cm and 4 cm. By having a sheet-like flow of molten metal along the receptor plate 54, the nuclei induced and released from the receptor plate 54 can be uniformly dispersed into the volume of the molten metal instantaneously on the receptor plate 54. If the surface area of the receptor plate is considered as the area available for the generation of the nuclei, then having a sheet-like form of molten metal will also serve to cool the molten metal more thoroughly throughout the volume of the metal instantaneously on the receptor plate 54. Without achieving this cooling throughout, nuclei released could be re-melted into molten metal and loss as from the total count of nuclei flowing into the mold or casting wheel. Accordingly, by having controller 500 control the height of the molten metal on the receptor plate 54, there is a synergetic effect when using the sheet-like molten metal in that there are both more nuclei per unit volume generated and less nuclei loss due to re-melting.

Components of the molten metal conveyor 50 can be made from a metal such as titanium, stainless steel alloys, low carbon steels or H13 steel, other high-temperature materials, a ceramic, a composite, or a polymer. Components of the molten metal conveyor 50 can also be made from one or more of niobium, a niobium alloy, titanium, a titanium alloy, tantalum, a tantalum alloy, copper, a copper alloy, rhenium, a rhenium alloy, steel, molybdenum, a molybdenum alloy, stainless steel, and a ceramic. The ceramic can be a silicon nitride ceramic, such as for example a silica alumina nitride or SIALON.

While not shown in FIG. 2, the magnetostrictive transducers 52 have an internal coil wrapped around a stack of magnetic layers. The coil provides a high frequency current producing a high frequency magnetic field which induces extraction and compression of the stack, and thereby impresses vibrations on plate 52.

Magnetostrictive transducers are typically composed of a large number of material plates that will expand and contract once an electromagnetic field is applied. More specifically, magnetostrictive transducers suitable for the present invention can include in one embodiment a large number of nickel (or other magnetostrictive material) plates or laminations arranged in parallel with one edge of each laminate attached to the bottom of a process container or other surface to be vibrated. A coil of wire is placed around the magnetostrictive material to provide the magnetic field. For example, when a flow of electrical current is supplied through the coil of wire, a magnetic field is created. This magnetic field causes the magnetostrictive material to contract or elongate, thereby introducing a sound wave into a fluid in contact with the expanding and contracting magnetostrictive material. Typical ultrasonic frequencies from magnetostrictive transducers suitable for the invention range from 20 to 200 kHz. Higher or lower frequencies can be used depending on the natural frequency of the magnetostrictive element.

For magnetostrictive transducers, nickel is one of the most commonly used materials. When a voltage is applied to the transducer, the nickel material expands and contracts at ultrasonic frequencies. In one embodiment of the invention, the nickel plates are directly silver brazed to a stainless steel plate. With reference to FIG. 2, the stainless steel plate of the magnetostrictive transducer is the surface that is vibrating at ultrasonic frequencies and (as shown in FIG. 2 is attached to vibratory (ultrasonic) plate 54.

U.S. Pat. No. 7,462,960 (the entire contents of which are incorporated herein by reference) describes an ultrasonic transducer driver having a giant magnetostrictive element. Accordingly, in one embodiment of the invention, the magnetostrictive element can be made from rare-earth-alloy-based materials such as Terfenol-D and its composites which have an unusually large magnetostrictive effect as compared with early transition metals, such as iron (Fe), cobalt (Co) and nickel (Ni). Alternatively, the magnetostrictive element in one embodiment of the invention can be made from iron (Fe), cobalt (Co) and nickel (Ni).

Alternatively, the magnetostrictive element in one embodiment of the invention can be made from one or more of the following alloys iron and terbium; iron and praseodymium; iron, terbium and praseodymium; iron and dysprosium; iron, terbium and dysprosium; iron, praseodymium and dysprodium; iron, terbium, praseodymium and dysprosium; iron, and erbium; iron and samarium; iron, erbium and samarium; iron, samarium and dysprosium; iron and holmium; iron, samarium and holmium; or mixture thereof.

U.S. Pat. No. 4,158,368 (the entire contents of which are incorporated herein by reference) describes a magnetostrictive transducer. As described therein and suitable for the present invention, the magnetostrictive transducer can include a plunger of a material exhibiting negative magnetostriction disposed within a housing. U.S. Pat. No. 5,588,466 (the entire contents of which are incorporated herein by reference) describes a magnetostrictive transducer. As described therein and suitable for the present invention, a magnetostrictive layer is applied to a flexible element, for example, a flexible beam. The flexible element is deflected by an external magnetic field. As described in the '466 patent and suitable for the present invention, a thin magnetostrictive layer can be used for the magnetostrictive element which consists of Tb(1-x) Dy(x) $Fe_2$. U.S. Pat. No. 4,599,591 (the entire contents of which are incorporated herein by reference) describes a magnetostrictive transducer. As described therein and suitable for the present invention, the magnetostrictive transducer can utilize a magnetostrictive material and a plurality of windings connected to multiple current sources having a phase relationship so as to establish a rotating magnetic induction vector within the magnetostrictive material. U.S. Pat. No. 4,986,808 (the entire contents of which are incorporated herein by reference) describes a magnetostrictive transducer. As described therein and suitable for the present invention, the magnetostrictive transducer can include a plurality of elongated strips of magnetostrictive material, each strip having a proximal end, a distal end and a substantially V-shaped cross section with each arm of the V is formed by a longitudinal length of the strip and each strip being attached to an adjacent strip at both the proximal end and the distal end to form and integral substantially rigid column having a central axis with fins extending radially relative to this axis.

U.S. Pat. No. 6,150,753 (the entire contents of which are incorporated herein by reference) describes ultrasonic transducer assembly, having a cobalt-base alloy housing with at least one planar wall section, and at least one ultrasonic transducer mounted to the planar wall section, the ultrasonic transducer operatively arranged to impart an ultrasonic vibrating force to the planar wall section of the housing. Both the background material and descriptions in the '753 patent, describing ways to mount ultrasonic transducers to stainless steel plates, can be used in the present invention to form mechanically stable coupling between transducers 52/56 and vibratory (ultrasonic) plate 54. For example, the ULTIMET® brand alloy, available from Haynes International, Inc. of Kokomo, Ind. ULTIMET® is a cobalt-chromium alloy suitable for the present invention. This alloy has a nominal chemical composition (weight percent) as follows: cobalt (54%), chromium (26%), nickel (9%), molybdenum (5%), tungsten (2%), and iron (3%). This alloy also contains trace amounts (less than 1% weight percent) of manganese, silicon, nitrogen and carbon.

U.S. Pat. No. 5,247,954 (the entire contents of which are incorporated herein by reference) describes a method of bonding of the piezoelectric ceramic transducers which does not exceed 250° C. This method can be used in the present invention to form mechanically stable coupling between transducers 52/56 and vibratory (ultrasonic) plate 54. For example, a low temperature brazing alloy is used to bond between a silvered piezoelectric ceramic transducers and a pre-metalized surface of plate 54. This solder can be a pre-formed 96.5% tin, 3.5% silver, and melts at about 221° C. Such a solder would stick to silver and silver/tungsten surfaces which had been fired onto surface of plate 54 prior to application of the low temperature solder. The attachment of the piezoelectric ceramic transducers to plate 54 would then take place in a furnace operating at 230° C.

Figure 3:
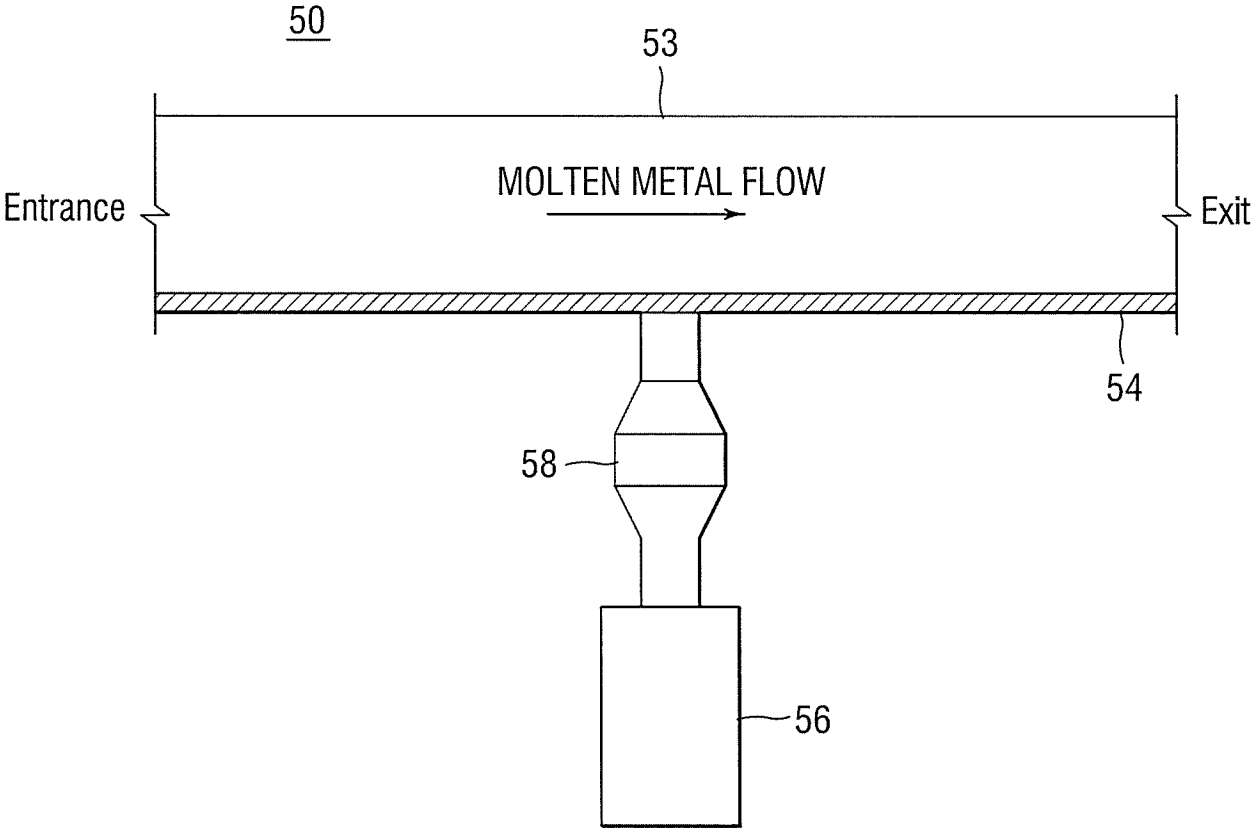
FIG. 3 is a schematic of a molten metal conveyor having a piezoelectric ultrasonic transducer attached to a vibratory plate 54.

In one embodiment of the invention, one or more piezoelectric ultrasonic devices are attached directly to the plate or receptor in contact with molten metal. FIG. 3 depicts a molten metal conveyor 50 (sidewalls not shown) having in this depiction one piezoelectric ultrasonic transducer 56 attached to the vibratory (ultrasonic) plate 54. In this embodiment, it is preferable (but not necessary) to use booster 58 to increase the ultrasonic power delivered to the plate.

In one aspect of the invention, piezoelectric transducers supplying the vibrational energy can be formed of a ceramic material that is sandwiched between electrodes which provide attachment points for electrical contact. Once a voltage is applied to the ceramic through the electrodes, the ceramic expands and contracts at ultrasonic frequencies. In one embodiment of the invention, piezoelectric transducer serving as vibrational energy source 40 is attached to a booster, which transfers the vibration to the probe. U.S. Pat. No. 9,061,928 (the entire contents of which are incorporated herein by reference) describes an ultrasonic transducer assembly including an ultrasonic transducer, an ultrasonic booster, an ultrasonic probe, and a booster cooling unit. The ultrasonic booster in the '928 patent is connected to the ultrasonic transducer to amplify acoustic energy generated by the ultrasonic transducer and transfer the amplified acoustic energy to the ultrasonic probe. The booster configuration of the '928 patent can be useful here in the present invention to provide energy to the ultrasonic probes directly or indirectly in contact with the liquid cooling medium discussed above.

Indeed, in one embodiment of the invention, an ultrasonic booster is used in the realm of ultrasonics to amplify or intensify the vibrational energy created by a piezoelectric transducer. The booster does not increase or decrease the frequency of the vibrations, it increases the amplitude of the vibration. (When a booster is installed backwards, it can also compress the vibrational energy.) In one embodiment of the invention, a booster connects between the piezoelectric transducer and the probe. In the case of using a booster for ultrasonic grain refining, below are an exemplary number of method steps illustrating the use of a booster with a piezoelectric vibrational energy source:

1) An electrical current is supplied to the piezoelectric transducer. The ceramic pieces within the transducer expand and contract once the electrical current is applied, this converts the electrical energy to mechanical energy.
2) Those vibrations in one embodiment are then transferred to a booster, which amplifies or intensifies this mechanical vibration.
3) The amplified or intensified vibrations from the booster in one embodiment are then propagated to the probe. The probe is then vibrating at the ultrasonic frequencies, thus creating cavitations.
4) The cavitations from the vibrating probe impact the casting band, which in one embodiment is in contact with the molten metal.
5) The cavitations in one embodiment break up the dendrites and creating an equiaxed grain structure.

In the embodiment of FIG. 3, while not shown, there may be more than one ultrasonic transducer 56 with such transducers attached and evenly spaced apart along a longitudinal length of vibratory (ultrasonic) plate 54. As above, transducers 56 need not be evenly spaced. Furthermore, the transducers 56 can be spaced with a lateral separation in a direction of the width of the plate 54.

Figure 4:
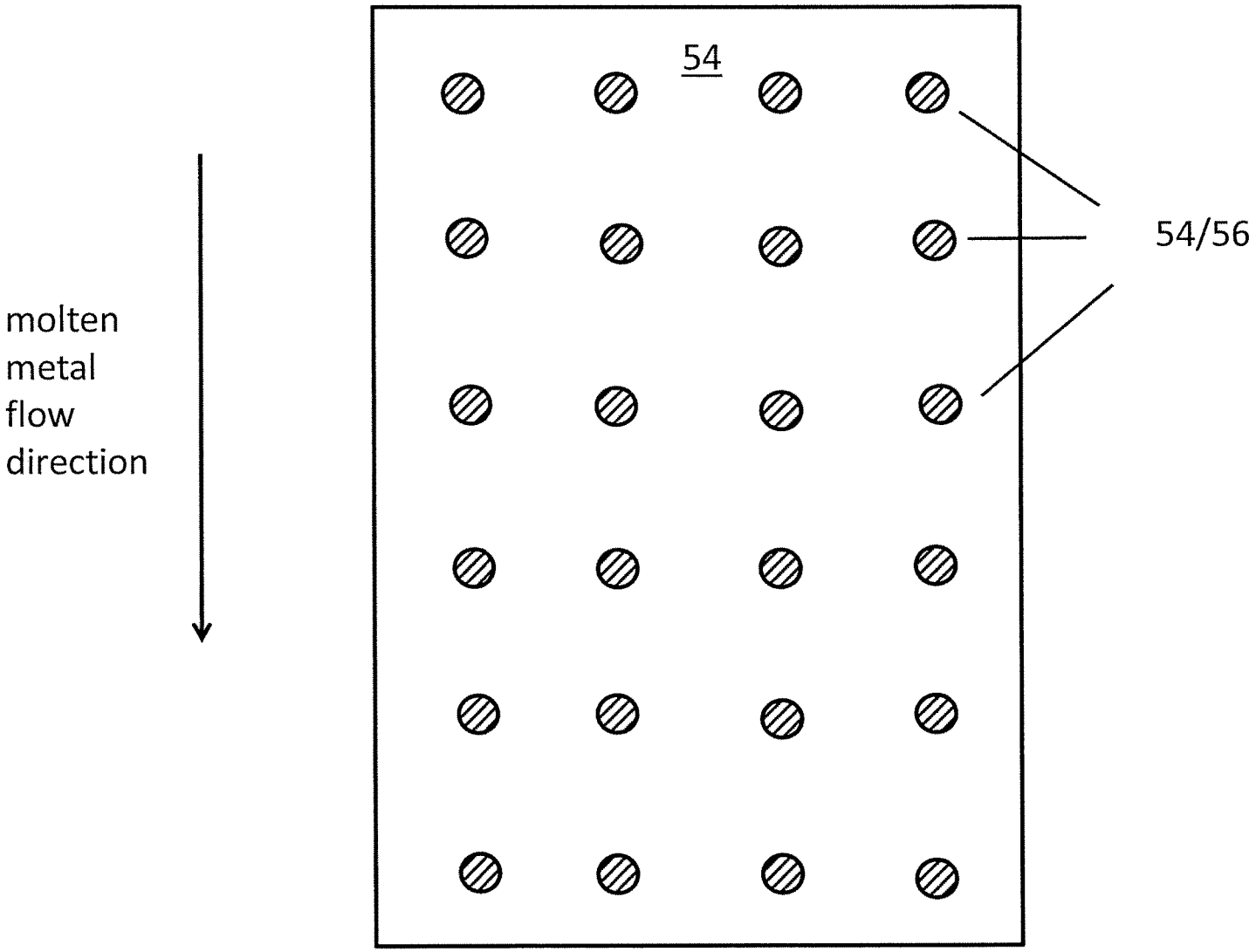
FIG. 4 is a schematic of multiple transducers attached in a two dimensional array to a bottom of vibratory plate.
Figure 5:
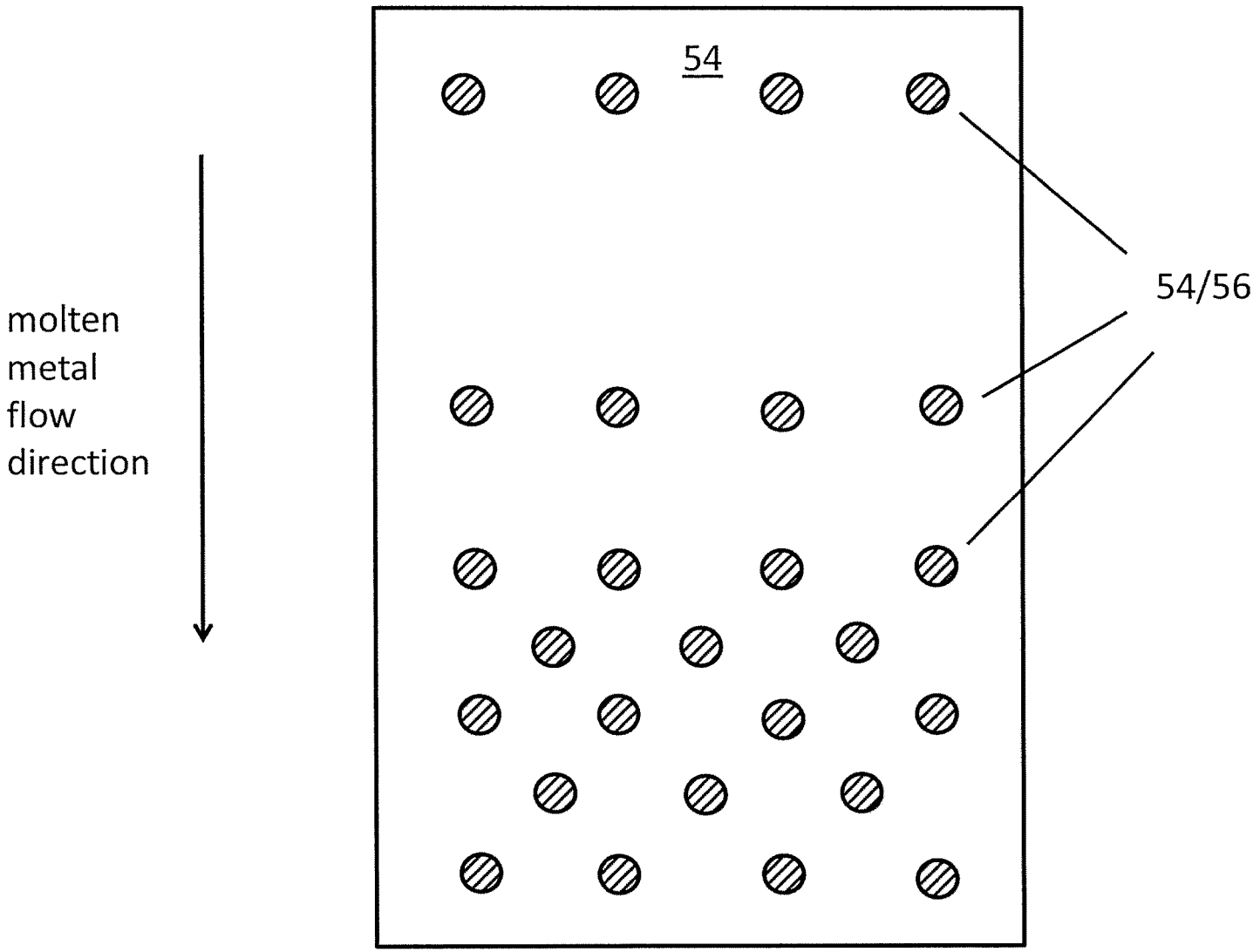
FIG. 5 is a schematic of multiple transducers attached in to a bottom of vibratory plate with a higher density at the end of the vibratory plate dispensing the molten metal.

FIG. 4 is depiction of multiple transducers 52/56 attached in a two dimensional array to the bottom of vibratory plate 54. The attachment pattern need not be a regular grid pattern (as shown). For example, the attachment pattern could be irregularly spaced. Alternatively, the attachment pattern could be with a higher density transducers 52/56 at the end of the vibratory plate 54 receiving the molten metal or at a higher density at the end of the dispensing the molten metal. FIG. 5 is depiction of multiple transducers 52/56 attached in to the bottom of vibratory plate 54 with a higher density at the end of the dispensing the molten metal. FIG. 5 also shows that the transducers can be placed in a diagonal configuration along the length of the receptor plate. In one embodiment of the invention, the vibrational energy is imparted with mechanically driven vibrators. The mechanically driven vibrators would take the place of any one or all of the transducers 52/56 noted above.

Mechanical vibrators useful for the invention can operate from 8,000 to 15,000 vibrations per minute, although higher and lower frequencies can be used. In one embodiment of the invention, the vibrational mechanism is configured to vibrate between 565 and 5,000 vibrations per second. In one embodiment of the invention, the vibrational mechanism is configured to vibrate at even lower frequencies down to a fraction of a vibration every second up to the 565 vibrations per second. Ranges of mechanically driven vibrations suitable for the invention include e.g., 6,000 to 9,000 vibrations per minute, 8,000 to 10,000 vibrations per minute, 10,000 to 12,000 vibrations per minute, 12,000 to 15,000 vibrations per minute, and 15,000 to 25,000 vibrations per minute. Ranges of mechanically driven vibrations suitable for the invention from the literature reports include for example of ranges from 133 to 250 Hz, 200 Hz to 283 Hz (12,000 to 17,000 vibrations per minute), and 4 to 250 Hz. Furthermore, a wide variety of mechanically driven oscillations can be impressed in the casting wheel 30 or the housing 44 by a simple hammer or plunger device driven periodically to strike the casting wheel 30 or the housing 44. In general, the mechanical vibrations can range up to 10 kHz. Accordingly, ranges suitable for the mechanical vibrations used in the invention include: 0 to 10 KHz, 10 Hz to 4000 Hz, 20 Hz to 2000 Hz, 40 Hz to 1000 Hz, 100 Hz to 500 Hz, and intermediate and combined ranges thereof, including a preferred range of 565 to 5,000 Hz.

Figure 6A:
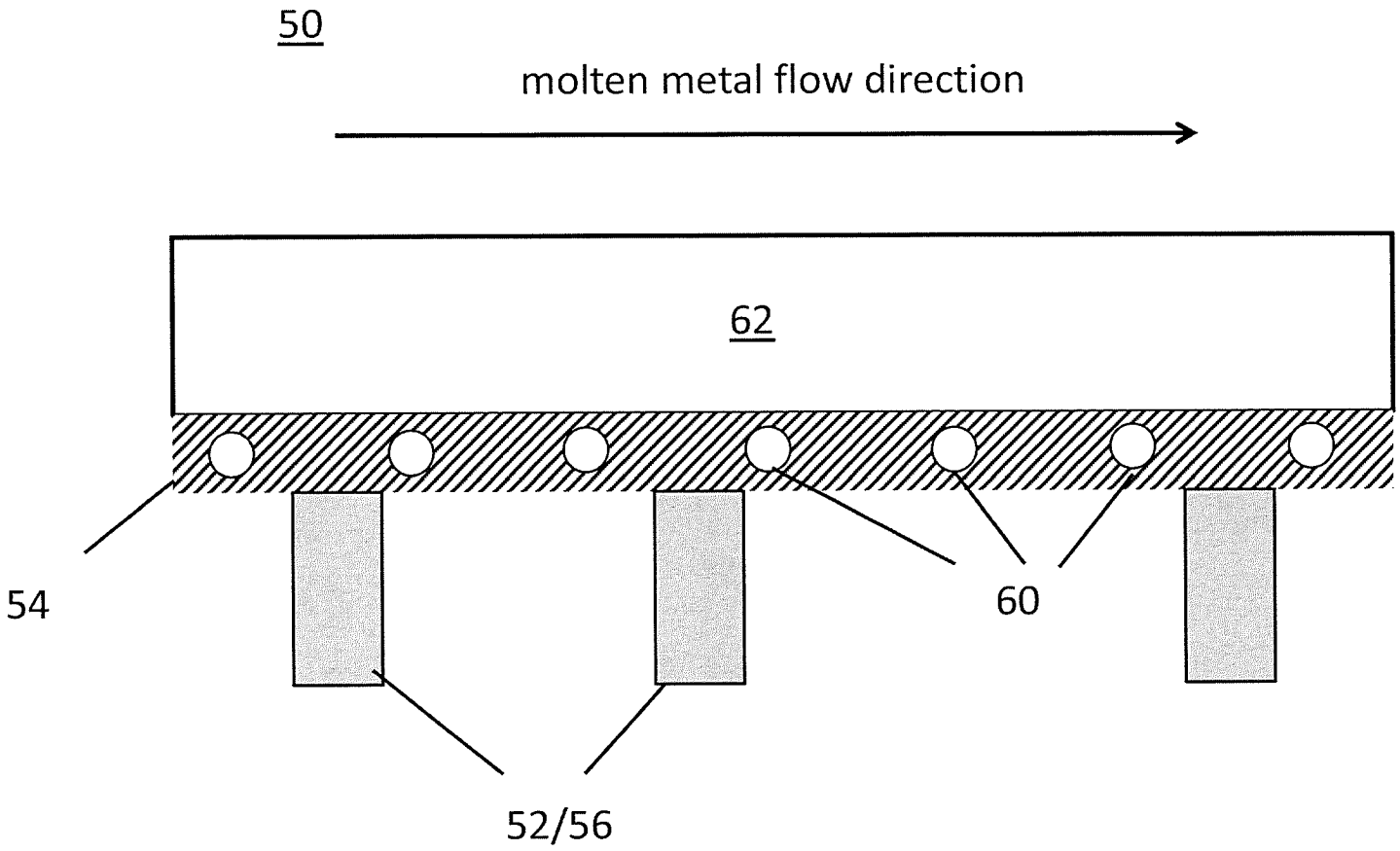
FIG. 6A is a side view of metal conveyor showing interior channels for the cooling medium to flow therein.

Regardless of the type of transducer used, the transducers are placed in mechanical and acoustic contact with plate 54. Silver brazing (or another type of high temperature alloy) could be used to join the transducer housing or the booster housing to plate 54. A cooling medium (compressed air, water, ionic fluids etc.) can flow through interior channels of plate 54. FIG. 6A is a side view of metal conveyor 50 showing interior channels 60 for the cooling medium to flow disposed in a thickness of the plate 54 and disposed below sidewalls 62. The cooling medium is used to reduce the temperature of the metal flowing across the plate. While there may be some coupling of the vibrational energy through the cooling medium, the majority of the vibrational energy is directly coupled from the transducer through a metal section of plate 54 into the molten aluminum.

In one embodiment of the invention, a cooling medium (compressed air, water, ionic fluids etc.) can flow across the bottom side of the plate 54. The cooling medium is used to reduce the temperature of the metal flowing across the plate. This cooling method is external from the plate and is not disposed in (or confined within) the thickness of the plate 54. Here, in one example, a forced air vortex system blows a gas across the bottom side of plate 54.

The thickness of the vibratory plate 54 can vary between 5 cm and 0.5 cm. The thickness of the vibratory plate 54 can also vary between 3 cm and 1 cm. The thickness of the vibratory plate 54 can also vary between 2 cm and 1.5 cm. The thickness of the vibratory plate 54 is not necessarily uniform along its length or width. The vibratory plate 54 can have thinner sections which may act as more as a diaphragm and amplify the vibrations. For thin vibratory plates, cooling may be provided by the attachment of cooling tubes to plate 54 and/or sidewalls 62. While depicted here with transducers mounted to the bottom of plate 54, the transducers could also or alternatively be placed on side wall 62.

Figure 6B:
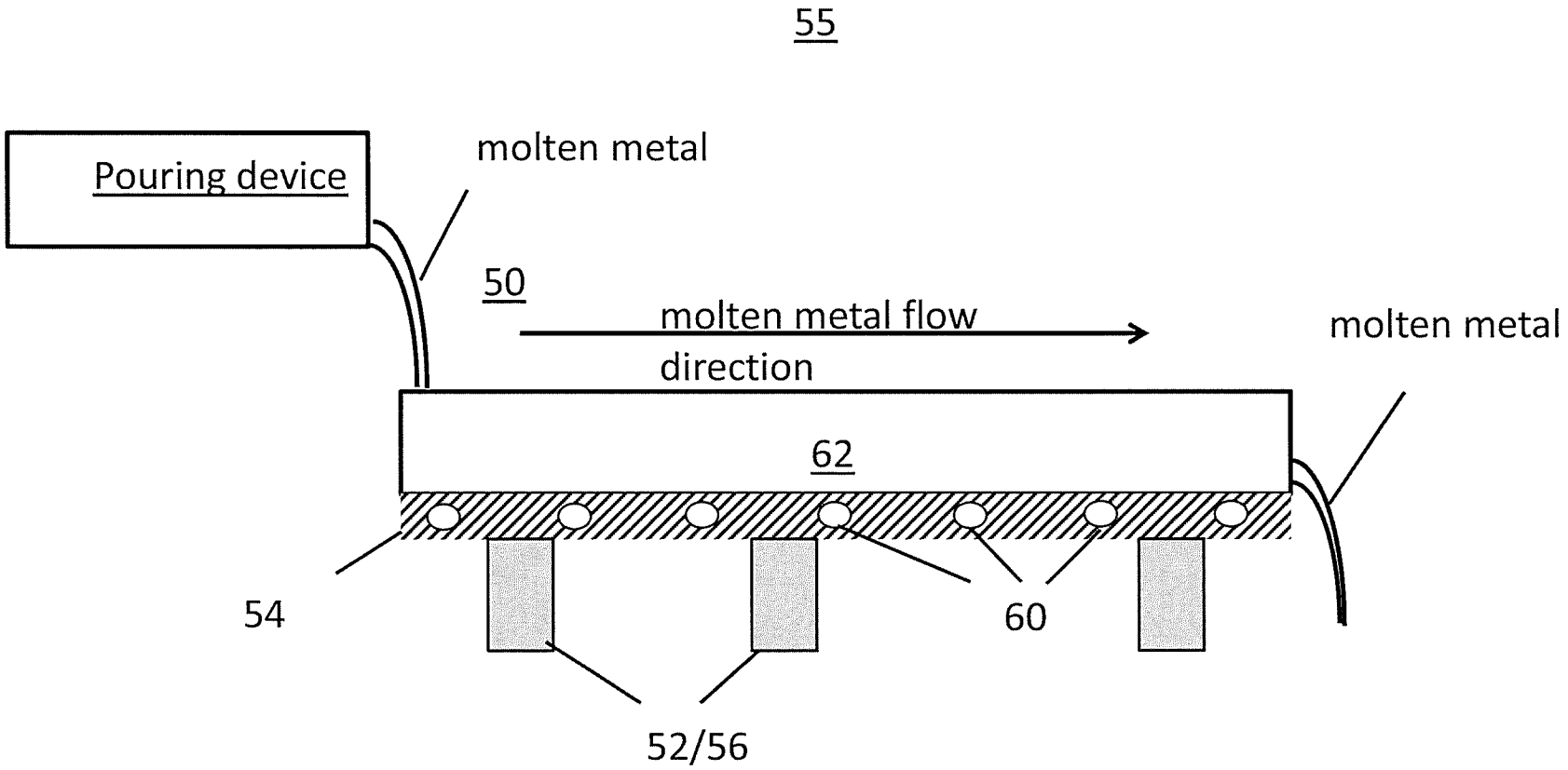
FIG. 6B is a view of a metal conveyor/pouring device according to the invention.

In one embodiment of the invention, the vibratory plate 54 can be the bottom of a pouring device, such as the bottom of pouring spout 11 shown in FIG. 1. Alternatively, the molten metal conveyor 50 can accept molten metal from pouring spout 11 and then deliver molten metal into a casting wheel. FIG. 6B is a view of a metal conveyor/pouring device 55 according to the invention. In the device 55 shown in FIG. 6B, there is a pouring device (e.g., pouring spout 11 shown in FIG. 1 or tundish 245 in FIG. 10) is configured and positioned to deliver molten metal onto the molten metal conveyor 50 discussed above. The molten metal is conveyed along the molten metal conveyor 50 (for example by gravity) where it is subject to cooling and the vibrational energy noted above. The molten metal exiting the molten metal conveyor 50 contains nuclei numerous nuclei which are not dependent on foreign impurities.

While water is a convenient cooling medium, other coolants can be used. In one embodiment of the invention, the cooling medium is a super chilled liquid (e.g., liquids at or below 0° C. to −196° C. liquid, that is a liquid between the temperatures of ice and liquid nitrogen). In one embodiment of the invention, a super chilled liquid such as liquid nitrogen is coupled with an ultrasonic or other vibrational energy source. The net effect is an increase in the solidification rates allowing faster processing. In one embodiment of the invention, the cooling medium exiting the probe(s) will not only create cavitations but will also atomize and super cool the molten metal. In a preferred embodiment, this results in an increase in the heat transfer in the zone of the casting wheel.

Figure 7:
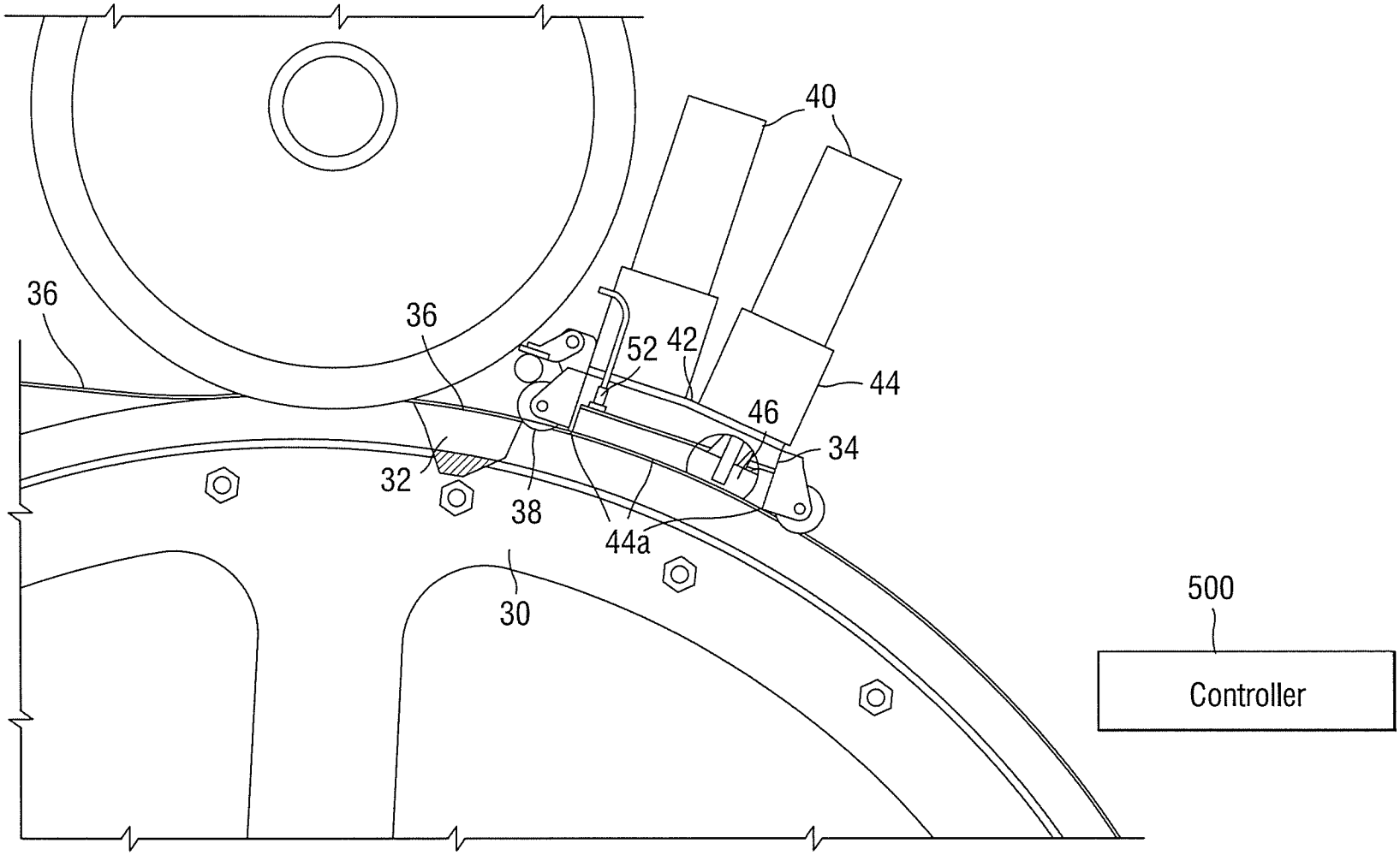
FIG. 7 is a schematic of a casting wheel configuration according to one embodiment of the invention utilizing a molten metal processing device in the casting wheel.

In one embodiment of the invention, as shown in FIG. 7, casting mill 2 includes a casting wheel 30*a* having a containment structure 32 (e.g., a trough or channel in the casting wheel 30) in which molten metal is poured (e.g., cast). FIG. 7 shows an embodiment where a molten metal processing device 34 is optionally included. Molten metal processing device 34 is described in the above-noted U.S. Ser. No. 15/337,645 (the entire contents of which are incorporated herein by reference). A band 36 (e.g., a steel flexible metal band) confines the molten metal to the containment structure 32 (i.e., the channel). Rollers 38 allow the molten metal processing device 34 to remain in a stationary position on the rotating casting wheel as the molten metal solidifies in the channel of the casting wheel and is conveyed away from the molten metal processing device 34.

In brief, molten metal processing device 34 includes an assembly 42 mounted on the casting wheel 30. The assembly 42 includes at least one vibrational energy source (e.g., vibrator 40), a housing 44 (i.e., a support device) holding the vibrational energy source 42. The assembly 42 includes at least one cooling channel 46 for transport of a cooling medium therethrough. The flexible band 36 is sealed to the housing 44 by a seal 44*a* attached to the underside of the housing, thereby permitting the cooling medium from the cooling channel to flow along a side of the flexible band opposite the molten metal in the channel of the casting wheel.

The casting band (i.e., a receptor of vibrational energy) can be made of at least one or more of chrome, niobium, a niobium alloy, titanium, a titanium alloy, tantalum, a tantalum alloy, copper, a copper alloy, nickel, a nickel alloy, rhenium, a rhenium alloy, steel, molybdenum, a molybdenum alloy, aluminum, an aluminum alloy, stainless steel, a ceramic, a composite, or a metal or alloys and combinations of the above.

A width of the casting band can range between 25 mm to 400 mm. In another embodiment of the invention, a width of the casting band ranges between 50 mm to 200 mm. In another embodiment of the invention, a width of the casting band ranges between 75 mm to 100 mm.

A thickness of the casting band can range between 0.5 mm to 10 mm. In another embodiment of the invention, a thickness of the casting band ranges between 1 mm to 5 mm. In another embodiment of the invention, a thickness of the casting band ranges between 2 mm to 3 mm.

As molten metal passes under the metal band 36 under vibrator 40, when the optional molten metal processing device 34 is utilized, vibrational energy is additionally supplied to the molten metal as the metal begins to cool and solidify. In one embodiment of the invention, the vibrational energy is imparted with ultrasonic transducers generated for example by piezoelectric devices ultrasonic transducer. In one embodiment of the invention, the vibrational energy is imparted with ultrasonic transducers generated for example by a magnetostrictive transducer. In one embodiment of the invention, the vibrational energy is imparted with mechanically driven vibrators (to be discussed later). The vibrational energy in one embodiment permits the formation of multiple small seeds, thereby producing a fine grain metal product. These sources of vibrational energy are the same type of sources as described above in reference to FIGS. 2-5.

In one aspect, the channel of the casting wheel 30 can be a refractory metal or other high temperature material such as copper, irons and steels, niobium, niobium and molybdenum, tantalum, tungsten, and rhenium, and alloys thereof including one or more elements such as silicon, oxygen, or nitrogen which can extend the melting points of these materials.

In one embodiment of the invention, the source of ultrasonic vibrations for vibrational energy (to plate 54 or for use in the molten metal processing device 34) provides a power of 1.5 kW at an acoustic frequency of 20 kHz. This invention is not restricted to those powers and frequencies. Rather, a broad range of powers and ultrasonic frequencies can be used although the following ranges are of interest.

Power: In general, powers between 50 and 5000 W for each sonotrode, depending on the dimensions of the sonotrode or probe. These powers are typically applied to the sonotrode to ensure that the power density at the end of the sonotrode is higher than 100 W/cm$^2$, which may be considered the threshold for causing cavitation in molten metals depending on the cooling rate of the molten metal, the molten metal type, and other factors. The powers at this area can range from 50 to 5000 W, 100 to 3000 W, 500 to 2000 W, 1000 to 1500 W or any intermediate or overlapping range. Higher powers for larger probe/sonotrode and lower powers for smaller probe are possible. In various embodiments of the invention, the applied vibrational energy power density can range from 10 W/cm$^2$ to 500 W/cm$^2$, or 20 W/cm$^2$ to 400 W/cm$^2$, or 30 W/cm$^2$ to 300 W/cm$^2$, or 50 W/cm$^2$ to 200 W/cm$^2$, or 70 W/cm$^2$ to 150 W/cm$^2$, or any intermediate or overlapping ranges thereof.

Frequency: In general, 5 to 400 kHz (or any intermediate range) may be used. Alternatively, 10 and 30 kHz (or any intermediate range) may be used. Alternatively, 15 and 25 kHz (or any intermediate range) may be used. The frequency applied can range from 5 to 400 KHz, 10 to 30 kHz, 15 to 25 kHz, 10 to 200 KHz, or 50 to 100 kHz or any intermediate or overlapping ranges thereof.

While described above with respect to ultrasonic and mechanically driven embodiments (applicable to plate 54 or for use in the molten metal processing device 34), the invention is not so limited to one or the other of these ranges, but can be used for a broad spectrum of vibrational energy up to 400 KHz including single frequency and multiple frequency sources. Additionally, a combination of sources (ultrasonic and mechanically driven sources, or different ultrasonic sources, or different mechanically driven sources or acoustic energy sources to be described below) can be used.

Aspects of the Invention

In one aspect of the invention, the vibrational energy (from low frequency mechanically-driven vibrators in the 8,000 to 15,000 vibrations per minute range or up to 10 KHz and/or ultrasonic frequencies in the range of 5 to 400 kHz) can be applied to the molten metal conveyor 50 or molten metal processing device 34 or both. In one aspect of the invention, the vibrational energy can be applied at multiple distinct frequencies. In one aspect of the invention, the vibrational energy can be applied to a variety of metal alloys including, but not limited to those metals and alloys listed below: Aluminum, Copper, Gold, Iron, Nickel, Platinum, Silver, Zinc, Magnesium, Titanium, Niobium, Tungsten, Manganese, Iron, and alloys and combinations thereof metals alloys including—Brass (Copper/Zinc), Bronze (Copper/Tin), Steel (iron/Carbon), Chromalloy (chromium), Stainless Steel (steel/Chromium), Tool Steel (Carbon/Tungsten/Manganese, Titanium (Iron/aluminum) and standardized grades of Aluminum alloys including—1100, 1350, 2024, 2224, 5052, 5154, 5356, 5183, 6101, 6201, 6061, 6053, 7050, 7075, 8XXX series; copper alloys including, bronze (noted above) and copper alloyed with a combination of Zinc, Tin, Aluminum, Silicon, Nickel, Silver; Magnesium alloyed with Aluminum, Zinc, Manganese, Silicon, Copper, Nickel, Zirconium, Beryllium, Calcium, Cerium, Neodymium, Strontium, Tin, Yttrium, rare earths; Iron and Iron alloyed with Chromium, Carbon, Silicon Chromium, Nickel, Potassium, Plutonium, Zinc, Zirconium, Titanium, Lead, Magnesium, Tin, Scandium; and other alloys and combinations thereof.

In one aspect of the invention, the vibrational energy (from low frequency mechanically-driven vibrators in the 8,000 to 15,000 vibrations per minute range or up to 10 KHz and/or ultrasonic frequencies in the range of 5 to 400 kHz) is coupled through plate 54 or band 36 or both into the solidifying metal respectively in molten metal conveyor 50 or under molten metal processing device 34. In one aspect of the invention, the vibrational energy is mechanically coupled between 565 and 5,000 Hz. In one aspect of the invention, the vibrational energy is mechanically driven at even lower frequencies down to a fraction of a vibration every second up to the 565 vibrations per second. In one aspect of the invention, the vibrational energy is ultrasonically driven at frequencies from the 5 kHz range to 400 kHz.

In one aspect, the cooling medium can be a liquid medium such as water. In one aspect, the cooling medium can be a gaseous medium such as one of compressed air or nitrogen. As noted above, a forced air vortex system can be used to supply a gas for cooling plate 54. In one aspect, the cooling medium can be a phase change material. It is preferred that the cooling medium be provided at a sufficient rate to undercool the metal adjacent the band 36 (less than 5 to 10° C. above the liquidus temperature of the alloy or even lower than the liquidus temperature).

In one aspect of the invention, equiaxed grains within the cast product are obtained without the necessity of adding impurity particles, such as titanium boride, into the metal or metallic alloy to increase the number of grains and improve uniform heterogeneous solidification. Instead of using the nucleating agents, in one aspect of the invention, vibrational energy can be used to create nucleating sites.

During operation, molten metal at a temperature substantially higher than the liquidus temperature of the alloy flows by gravity from molten metal conveyor 50 into the channel of castling wheel 30 and optionally passes under the molten metal processing device 34 where it is exposed to vibrational energy (i.e. ultrasonic or mechanically-driven vibrations). The temperature of the molten metal flowing into the channel of the casting depends on the type of alloy chose, the rate of pour, the size of the casting wheel channel, among others. For aluminum alloys, the casting temperature can range from 1220° F. to 1350° F., with preferred ranges in between such as for example, 1220 to 1300° F., 1220 to 1280° F., 1220 to 1270° F., 1220 to 1340° F., 1240 to 1320° F., 1250 to 1300° F., 1260 to 1310° F., 1270 to 1320° F., 1320 to 1330° F., with overlapping and intermediate ranges and variances of +/−10 degrees F. also suitable. The channel of casting wheel 30 is cooled to ensure that the molten metal in the channel is close to the sub-liquidus temperature (e.g., less than 5 to 10° C. above the liquidus temperature of the alloy or even lower than the liquidus temperature, although the pouring temperature can be much higher than 10° C.). During operation, the atmosphere about the molten metal may be controlled by way of a shroud (not shown) which is filled or purged for example with an inert gas such as Ar, He, or nitrogen. The molten metal on the casting wheel 30 is typically in a state of thermal arrest in which the molten metal is converting from a liquid to a solid.

As a result of the undercooling close to the sub-liquidus temperature, solidification rates are not slow enough to allow equilibrium through the solidus-liquidus interface, which in turn results in variations in the compositions across the cast bar. The non-uniformity of chemical composition results in segregation. In addition, the amount of segregation is directly related to the diffusion coefficients of the various elements in the molten metal as well as the heat transfer rates. Another type of segregation is the place where constituents with the lower melting points will freeze first.

In the ultrasonic or mechanically-driven vibration embodiments of the invention, the vibrational energy agitates the molten metal as it cools, regardless of the molten metal being in molten metal conveyor 50 or under molten metal processing device 34. In this embodiment, the vibrational energy is imparted with an energy which agitates and effectively stirs the molten metal. In one embodiment of the invention, the mechanically-driven vibrational energy serves to continuously stir the molten metal as its cools. In various casting alloy processes, it is desirable to have high concentrations of silicon into an aluminum alloy. However, at higher silicon concentrations, silicon precipitates can form. By "remixing" these precipitates back into the molten state, elemental silicon may go at least partially back into solution. Alternatively, even if the precipitates remain, the mixing will not result in the silicon precipitates being segregated, thereby causing more abrasive wear on the downstream metal die and rollers.

In various metal alloy systems, the same kind of effect occurs where one component of the alloy (typically the higher melting point component) precipitates in a pure form in effect "contaminating" the alloy with particles of the pure component. In general, when casting an alloy, segregation occurs, whereby the concentration of solute is not constant throughout the casting. This can be caused by a variety of processes. Microsegregation, which occurs over distances comparable to the size of the dendrite arm spacing, is believed to be a result of the first solid formed being of a lower concentration than the final equilibrium concentration, resulting in partitioning of the excess solute into the liquid, so that solid formed later has a higher concentration. Macrosegregation occurs over similar distances to the size of the casting. This can be caused by a number of complex processes involving shrinkage effects as the casting solidifies, and a variation in the density of the liquid as solute is partitioned. It is desirable to prevent segregation during casting, to give a solid billet that has uniform properties throughout.

Accordingly, some alloys which would benefit from the vibrational energy treatment of the invention include those alloys noted above.

Figure 8:
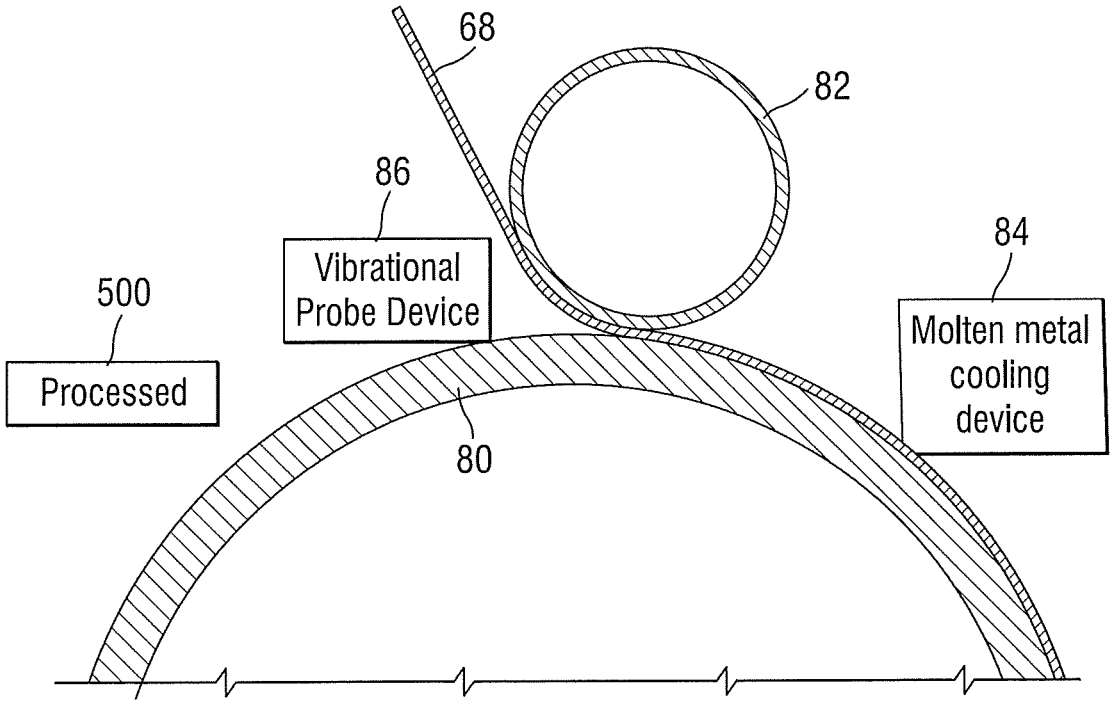
FIG. 8 is a schematic of a casting wheel configuration according to one embodiment of the invention showing a vibrational probe device coupled directly to the molten metal cast in the casting wheel.

FIG. 8 is a schematic of a casting wheel configuration according to one embodiment of the invention specifically with a vibrational probe device 86 having a probe (not shown) inserted directly to the molten metal cast in a casting wheel 80. Molten metal can be supplied to the casting wheel 80 by the molten metal conveyor 50 (described above). The probe of the vibrational probe device 86 would be of a construction similar to that known in the art for ultrasonic degassing. FIG. 8 depicts a roller 82 pressing band 88 onto a rim of the casting wheel 80. The vibrational probe device 86 couples vibrational energy (ultrasonic or mechanically driven energy) directly or indirectly into molten metal cast into a channel (not shown) of the casting wheel 80. As the casting wheel 80 rotates counterclockwise, the molten metal transits under roller 82 and comes in contact with optional molten metal cooling device 84.

In this embodiment, vibrational energy can be coupled into the molten metal in casting wheel 80 while it is being cooled through an air or gas. In another embodiment, acoustic oscillators (e.g., audio amplifiers) can be used to generate and transmit acoustic waves into the molten metal. In this embodiment, the ultrasonic or mechanically-driven vibrators discussed above would be replaced with or supplemented by the acoustic oscillators. Audio amplifiers suitable for the invention would provide acoustic oscillations from 1 to 20,000 Hz. Acoustic oscillations higher or lower than this range can be used. For example, acoustic oscillations from 0.5 to 20 Hz; 10 to 500 Hz, 200 to 2,000 Hz, 1,000 to 5,000 Hz, 2,000 to 10,000 Hz, 5,000 to 14,000 Hz, and 10,000 to 16,000 Hz, 14,000 to 20,000 Hz, and 18,000 to 25,000 Hz can be used. Electroacoustic transducers can be used to generate and transmit the acoustic energy.

In one embodiment of the invention, the acoustic energy can be coupled through a gaseous medium directly into the molten metal where the acoustic energy vibrates the molten metal. In one embodiment of the invention, the acoustic energy can be coupled through a gaseous medium indirectly into the molten metal where the acoustic energy vibrates the band 36 or other support structure containing the molten metal, which in turn vibrates the molten metal.

The present invention also has utility in stationary molds and in vertical casting mills.

Figure 9:
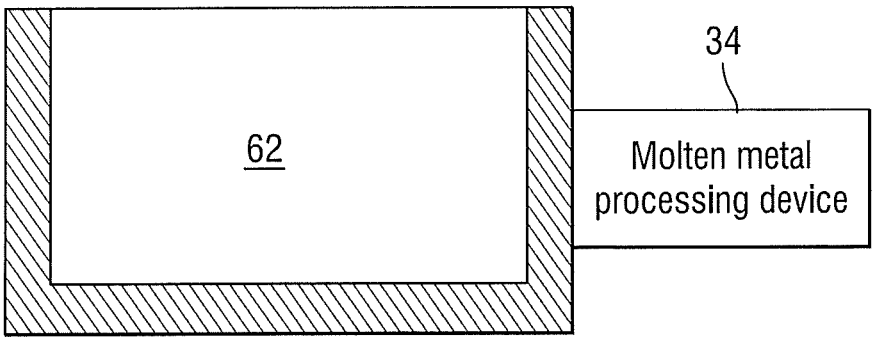
FIG. 9 is a schematic of a stationary mold utilizing the vibrational energy sources of the invention.
Figure 10A:
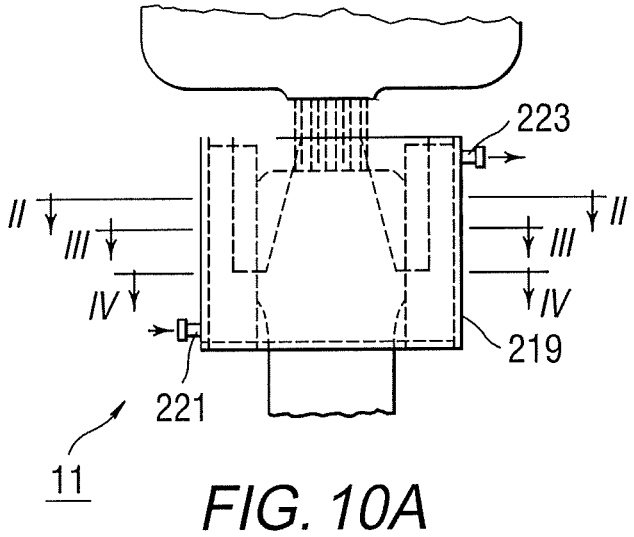
FIG. 10A is a cross sectional schematic of selected components of a vertical casting mill.
Figure 10B:
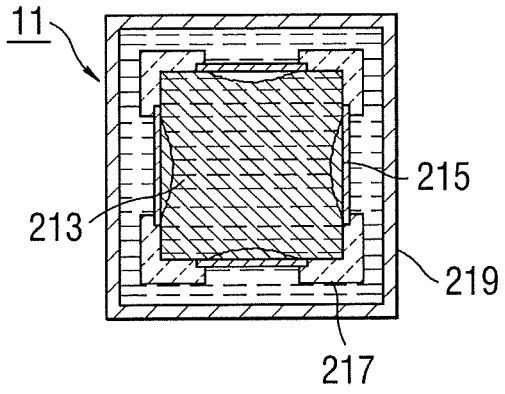
FIG. 10B is a cross sectional schematic of other components of a vertical casting mill.
Figure 10C:
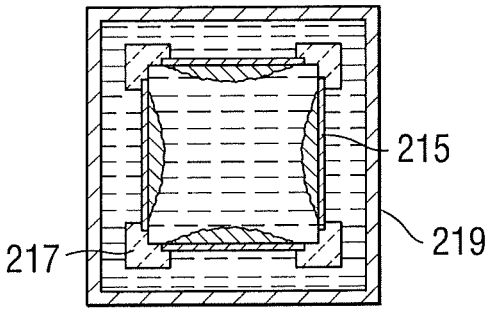
FIG. 10C is a cross sectional schematic of other components of a vertical casting mill.
Figure 10D:
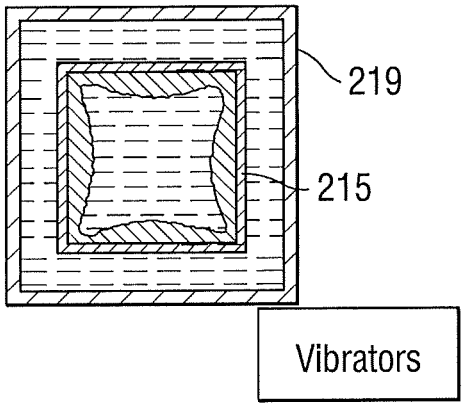
FIG. 10D is a cross sectional schematic of other components of a vertical casting mill.

For stationary mills, the molten metal would be poured into a stationary cast 62 such as the one shown in FIG. 9, which itself has a molten metal processing device 34 (shown schematically). In one embodiment, the molten metal processing device 34 would be replaced or supplemented with the molten metal conveyor 50. In this way, vibrational energy (from low frequency mechanically-driven vibrators operating up to 10 KHz and/or ultrasonic frequencies in the range of 5 to 400 kHz) can induce nucleation at points in the stationary cast where the molten metal is beginning to cool from the molten state and enter the solid state (i.e., the thermal arrest state).

FIGS. 10A-10D depict selected components of a vertical casting mill. More details of these components and other aspects of a vertical casting mill are found in U.S. Pat. No. 3,520,352 (the entire contents of which are incorporated herein by reference). As shown in FIGS. 10A-10D, the vertical casting mill includes a molten metal casting cavity 213, which is generally square in the embodiment illustrated, but which may be round, elliptical, polygonal or any other suitable shape, and which is bounded by vertical, mutually intersecting first wall portions 215, and second or corner wall portions, 217, situated in the top portion of the mold. A fluid retentive envelope 219 surrounds the walls 215 and corner members 217 of the casting cavity in spaced apart relation thereto. Envelope 219 is adapted to receive a cooling fluid, such as water, via an inlet conduit 221, and to discharge the cooling fluid via an outlet conduit 223.

While the first wall portions 215 are preferably made of a highly thermal conductive material such as copper, the second or corner wall portions 217 are constructed of lesser thermally conductive material, such as, for example, a ceramic material. As shown in FIGS. 10A-10D, the corner wall portions 217 have a generally L-shaped or angular cross section, and the vertical edges of each corner slope downwardly and convergently toward each other. Thus, the corner member 217 terminates at some convenient level in the mold above of the discharge end of the mold which is between the transverse sections.

In operation, molten metal flows from a tundish 245 into a casting mold that reciprocates vertically and a cast strand of metal is continuously withdrawn from the mold. The molten metal is first chilled in the mold upon contacting the cooler mold walls in what may be considered as a first cooling zone. The tundish 245 could include as part of its configuration the molten conveyor 50 or the molten conveyor 50 could be disposed between tundish 245 and molten metal casting cavity 213. Heat is rapidly removed from the molten metal in this zone, and a skin of material is believed to form completely around a central pool of molten metal.

In one embodiment of the invention, the vibrational energy sources of the molten conveyor 50 generate nuclei in the molten metal before the metal flows into the stationary mold. In one embodiment of the invention, the above-described ultrasonic grain refining is combined with above-noted ultrasonic degassing to remove impurities from the molten bath before the metal is cast.

Figure 11:
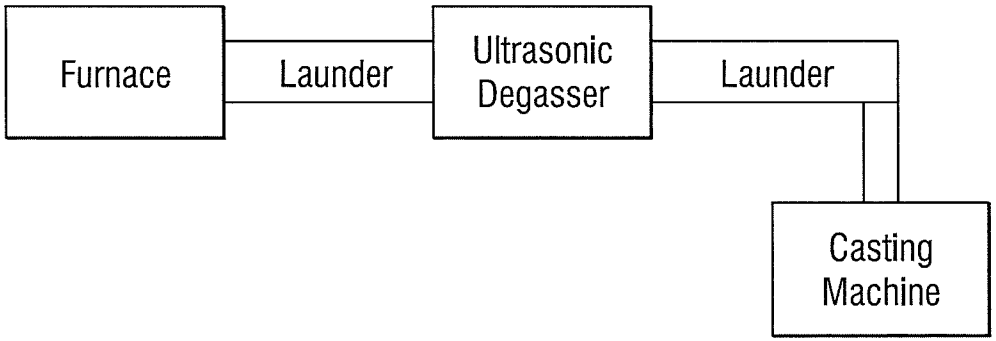
FIG. 11 is a schematic of an embodiment of the invention utilizing both ultrasonic degassing and ultrasonic grain refinement.

FIG. 11 is a schematic depicting an embodiment of the invention utilizing both ultrasonic degassing and ultrasonic grain refinement. As shown therein, a furnace is a source of molten metal. The molten metal is transported in a launder from the furnace. In one embodiment of the invention, an ultrasonic degasser is disposed in the path of launder prior to the molten metal being provided into a casting machine (e.g., casting wheel) containing an ultrasonic grain refiner (not shown). In one embodiment of the invention, the ultrasonic degasser is disposed in the molten metal conveyor 50 prior to the molten metal being provided into a casting machine (e.g., poured onto a casting wheel).

While not limited to the following specific ultrasonic degassers, the '336 patent describes degassers which are suitable for different embodiments of the present invention. One suitable degasser would be an ultrasonic device having an ultrasonic transducer; an elongated probe comprising a first end and a second end, the first end attached to the ultrasonic transducer and the second end comprising a tip; and a purging gas delivery system, wherein the purging gas delivery system may comprise a purging gas inlet and a purging gas outlet. In some embodiments, the purging gas outlet may be within about 10 cm (or 5 cm, or 1 cm) of the tip of the elongated probe, while in other embodiments, the purging gas outlet may be at the tip of the elongated probe. In addition, the ultrasonic device may comprise multiple probe assemblies and/or multiple probes per ultrasonic transducer.

While not limited to the following specific ultrasonic degassers, the '397 patent describes degassers which are also suitable for different embodiments of the present invention. One suitable degasser would be an ultrasonic device having an ultrasonic transducer; a probe attached to the ultrasonic transducer, the probe comprising a tip; and a gas delivery system, the gas delivery system comprising a gas inlet, a gas flow path through the probe, and a gas outlet at the tip of the probe. In an embodiment, the probe may be an elongated probe comprising a first end and a second end, the first end attached to the ultrasonic transducer and the second end comprising a tip. Moreover, the probe may comprise stainless steel, titanium, niobium, a ceramic, and the like, or a combination of any of these materials. In another embodiment, the ultrasonic probe may be a unitary SIALON probe with the integrated gas delivery system therethrough. In yet another embodiment, the ultrasonic device may comprise multiple probe assemblies and/or multiple probes per ultrasonic transducer.

In one embodiment of the invention, ultrasonic degasification using for example the ultrasonic probes discussed above complements ultrasonic grain refinement. In various examples of ultrasonic degasification, a purging gas is added to the molten metal e.g., by way of the probes discussed above at a rate in a range from about 1 to about 50 L/min. By a disclosure that the flow rate is in a range from about 1 to about 50 L/min, the flow rate may be about 1, about 2, about 3, about 4, about 5, about 6, about 7, about 8, about 9, about 10, about 11, about 12, about 13, about 14, about 15, about 16, about 17, about 18, about 19, about 20, about 21, about 22, about 23, about 24, about 25, about 26, about 27, about 28, about 29, about 30, about 31, about 32, about 33, about 34, about 35, about 36, about 37, about 38, about 39, about 40, about 41, about 42, about 43, about 44, about 45, about 46, about 47, about 48, about 49, or about 50 L/min. Additionally, the flow rate may be within any range from about 1 to about 50 L/min (for example, the rate is in a range from about 2 to about 20 L/min), and this also includes any combination of ranges between about 1 and about 50 L/min. Intermediate ranges are possible. Likewise, all other ranges disclosed herein should be interpreted in a similar manner.

Embodiments of the present invention related to ultrasonic degasification and ultrasonic grain refinement may provide systems, methods, and/or devices for the ultrasonic degassing of molten metals included but not limited to, aluminum, copper, steel, zinc, magnesium, and the like, or combinations of these and other metals (e.g., alloys). The processing or casting of articles from a molten metal may require a bath containing the molten metal, and this bath of the molten metal may be maintained at elevated temperatures. For instance, molten copper may be maintained at temperatures of around 1100° C., while molten aluminum may be maintained at temperatures of around 750° C.

As used herein, the terms "bath," "molten metal bath," and the like are meant to encompass any container that might contain a molten metal, inclusive of vessel, crucible, trough, launder, furnace, ladle, and so forth. The bath and molten metal bath terms are used to encompass batch, continuous, semi-continuous, etc., operations and, for instance, where the molten metal is generally static (e.g., often associated with a crucible) and where the molten metal is generally in motion (e.g., often associated with a launder).

Many instruments or devices may be used to monitor, to test, or to modify the conditions of the molten metal in the bath, as well as for the final production or casting of the desired metal article. There is a need for these instruments or devices to better withstand the elevated temperatures encountered in molten metal baths, beneficially having a longer lifetime and limited to no reactivity with the molten metal, whether the metal is (or the metal comprises) aluminum, or copper, or steel, or zinc, or magnesium, and so forth.

Furthermore, molten metals may have one or more gasses dissolved in them, and these gasses may negatively impact the final production and casting of the desired metal article, and/or the resulting physical properties of the metal article itself. For instance, the gas dissolved in the molten metal may comprise hydrogen, oxygen, nitrogen, sulfur dioxide, and the like, or combinations thereof. In some circumstances, it may be advantageous to remove the gas, or to reduce the amount of the gas in the molten metal. As an example, dissolved hydrogen may be detrimental in the casting of aluminum (or copper, or other metal or alloy) and, therefore, the properties of finished articles produced from aluminum (or copper, or other metal or alloy) may be improved by reducing the amount of entrained hydrogen in the molten bath of aluminum (or copper, or other metal or alloy). Dissolved hydrogen over 0.2 ppm, over 0.3 ppm, or over 0.5 ppm, on a mass basis, may have detrimental effects on the casting rates and the quality of resulting aluminum (or copper, or other metal or alloy) rods and other articles. Hydrogen may enter the molten aluminum (or copper, or other metal or alloy) bath by its presence in the atmosphere above the bath containing the molten aluminum (or copper, or other metal or alloy), or it may be present in aluminum (or copper, or other metal or alloy) feedstock starting material used in the molten aluminum (or copper, or other metal or alloy) bath.

Attempts to reduce the amounts of dissolved gasses in molten metal baths have not been completely successful. Often, these processes in the past involved additional and expensive equipment, as well as potentially hazardous materials. For instance, a process used in the metal casting industry to reduce the dissolved gas content of a molten metal may consist of rotors made of a material such as graphite, and these rotors may be placed within the molten metal bath. Chlorine gas additionally may be added to the molten metal bath at positions adjacent to the rotors within the molten metal bath. While chlorine gas addition may be successful in reducing, for example, the amount of dissolved hydrogen in a molten metal bath in some situations, this conventional process has noticeable drawbacks, not the least of which are cost, complexity, and the use of potentially hazardous and potentially environmentally harmful chlorine gas.

Additionally, molten metals may have impurities present in them, and these impurities may negatively impact the final production and casting of the desired metal article, and/or the resulting physical properties of the metal article itself. For instance, the impurity in the molten metal may comprise an alkali metal or other metal that is neither required nor desired to be present in the molten metal. Small percentages of certain metals are present in various metal alloys, and such metals would not be considered to be impurities. As non-limiting examples, impurities may comprise lithium, sodium, potassium, lead, and the like, or combinations thereof. Various impurities may enter a molten metal bath (aluminum, copper, or other metal or alloy) by their presence in the incoming metal feedstock starting material used in the molten metal bath.

Embodiments of this invention related to ultrasonic degasification and ultrasonic grain refinement may provide methods for reducing an amount of a dissolved gas in a molten metal bath or, in alternative language, methods for degassing molten metals. One such method may include operating an ultrasonic device in the molten metal bath, and introducing a purging gas into the molten metal bath in close proximity to the ultrasonic device. The dissolved gas may be or may comprise oxygen, hydrogen, sulfur dioxide, and the like, or combinations thereof. For example, the dissolved gas may be or may comprise hydrogen. The molten metal bath may comprise aluminum, copper, zinc, steel, magnesium, and the like, or mixtures and/or combinations thereof (e.g., including various alloys of aluminum, copper, zinc, steel, magnesium, etc.). In some embodiments related to ultrasonic degasification and ultrasonic grain refinement, the molten metal bath may comprise aluminum, while in other embodiments, the molten metal bath may comprise copper. Accordingly, the molten metal in the bath may be aluminum or, alternatively, the molten metal may be copper.

Moreover, embodiments of this invention may provide methods for reducing an amount of an impurity present in a molten metal bath or, in alternative language, methods for removing impurities. One such method related to ultrasonic degasification and ultrasonic grain refinement may comprise operating an ultrasonic device in the molten metal bath, and introducing a purging gas into the molten metal bath in close proximity to the ultrasonic device. The impurity may be or may comprise lithium, sodium, potassium, lead, and the like, or combinations thereof. For example, the impurity may be or may comprise lithium or, alternatively, sodium. The molten metal bath may comprise aluminum, copper, zinc, steel, magnesium, and the like, or mixtures and/or combinations thereof (e.g., including various alloys of aluminum, copper, zinc, steel, magnesium, etc.). In some embodiments, the molten metal bath may comprise aluminum, while in other embodiments, the molten metal bath may comprise copper. Accordingly, the molten metal in the bath may be aluminum or, alternatively, the molten metal may be copper.

The purging gas related to ultrasonic degasification and ultrasonic grain refinement employed in the methods of degassing and/or methods of removing impurities disclosed herein may comprise one or more of nitrogen, helium, neon, argon, krypton, and/or xenon, but is not limited thereto. It is contemplated that any suitable gas may be used as a purging gas, provided that the gas does not appreciably react with, or dissolve in, the specific metal(s) in the molten metal bath. Additionally, mixtures or combinations of gases may be employed. According to some embodiments disclosed herein, the purging gas may be or may comprise an inert gas; alternatively, the purging gas may be or may comprise a noble gas; alternatively, the purging gas may be or may comprise helium, neon, argon, or combinations thereof; alternatively, the purging gas may be or may comprise helium; alternatively, the purging gas may be or may comprise neon; or alternatively, the purging gas may be or may comprise argon. Additionally, in some embodiments, the conventional degassing technique can be used in conjunction with ultrasonic degassing processes disclosed herein. Accordingly, the purging gas may further comprise chlorine gas in some embodiments, such as the use of chlorine gas as the purging gas alone or in combination with at least one of nitrogen, helium, neon, argon, krypton, and/or xenon.

However, in other embodiments of this invention, methods related to ultrasonic degasification and ultrasonic grain refinement for degassing or for reducing an amount of a dissolved gas in a molten metal bath may be conducted in the substantial absence of chlorine gas, or with no chlorine gas present. As used herein, a substantial absence means that no more than 5% chlorine gas by weight may be used, based on the amount of purging gas used. In some embodiments, the methods disclosed herein may comprise introducing a purging gas, and this purging gas may be selected from the group consisting of nitrogen, helium, neon, argon, krypton, xenon, and combinations thereof.

The amount of the purging gas introduced into the bath of molten metal may vary depending on a number of factors. Often, the amount of the purging gas related to ultrasonic degasification and ultrasonic grain refinement introduced in a method of degassing molten metals (and/or in a method of removing impurities from molten metals) in accordance with embodiments of this invention may fall within a range from about 0.1 to about 150 standard liters/min (L/min). In some embodiments, the amount of the purging gas introduced may be in a range from about 0.5 to about 100 L/min, from about 1 to about 100 L/min, from about 1 to about 50 L/min, from about 1 to about 35 L/min, from about 1 to about 25 L/min, from about 1 to about 10 L/min, from about 1.5 to about 20 L/min, from about 2 to about 15 L/min, or from about 2 to about 10 L/min. These volumetric flow rates are in standard liters per minute, i.e., at a standard temperature (21.1° C.) and pressure (101 kPa).

In continuous or semi-continuous molten metal operations, the amount of the purging gas introduced into the bath of molten metal may vary based on the molten metal output or production rate. Accordingly, the amount of the purging gas introduced in a method of degassing molten metals (and/or in a method of removing impurities from molten metals) in accordance with such embodiments related to ultrasonic degasification and ultrasonic grain refinement may fall within a range from about 10 to about 500 mL/hr of purging gas per kg/hr of molten metal (mL purging gas/kg molten metal). In some embodiments, the ratio of the volumetric flow rate of the purging gas to the output rate of the molten metal may be in a range from about 10 to about 400 mL/kg; alternatively, from about 15 to about 300 mL/kg; alternatively, from about 20 to about 250 mL/kg; alternatively, from about 30 to about 200 mL/kg; alternatively, from about 40 to about 150 mL/kg; or alternatively, from about 50 to about 125 mL/kg. As above, the volumetric flow rate of the purging gas is at a standard temperature (21.1° C.) and pressure (101 kPa).

Methods for degassing molten metals consistent with embodiments of this invention and related to ultrasonic degasification and ultrasonic grain refinement may be effective in removing greater than about 10 weight percent of the dissolved gas present in the molten metal bath, i.e., the amount of dissolved gas in the molten metal bath may be reduced by greater than about 10 weight percent from the amount of dissolved gas present before the degassing process was employed. In some embodiments, the amount of dissolved gas present may be reduced by greater than about 15 weight percent, greater than about 20 weight percent, greater than about 25 weight percent, greater than about 35 weight percent, greater than about 50 weight percent, greater than about 75 weight percent, or greater than about 80 weight percent, from the amount of dissolved gas present before the degassing method was employed. For instance, if the dissolved gas is hydrogen, levels of hydrogen in a molten bath containing aluminum or copper greater than about 0.3 ppm or 0.4 ppm or 0.5 ppm (on a mass basis) may be detrimental and, often, the hydrogen content in the molten metal may be about 0.4 ppm, about 0.5 ppm, about 0.6 ppm, about 0.7 ppm, about 0.8 ppm, about 0.9 ppm, about 1 ppm, about 1.5 ppm, about 2 ppm, or greater than 2 ppm. It is contemplated that employing the methods disclosed in embodiments of this invention may reduce the amount of the dissolved gas in the molten metal bath to less than about 0.4 ppm; alternatively, to less than about 0.3 ppm; alternatively, to less than about 0.2 ppm; alternatively, to within a range from about 0.1 to about 0.4 ppm; alternatively, to within a range from about 0.1 to about 0.3 ppm; or alternatively, to within a range from about 0.2 to about 0.3 ppm. In these and other embodiments, the dissolved gas may be or may comprise hydrogen, and the molten metal bath may be or may comprise aluminum and/or copper.

Embodiments of this invention related to ultrasonic degasification and ultrasonic grain refinement and directed to methods of degassing (e.g., reducing the amount of a dissolved gas in bath comprising a molten metal) or to methods of removing impurities may comprise operating an ultrasonic device in the molten metal bath. The ultrasonic device may comprise an ultrasonic transducer and an elongated probe, and the probe may comprise a first end and a second end. The first end may be attached to the ultrasonic transducer and the second end may comprise a tip, and the tip of the elongated probe may comprise niobium. Specifics on illustrative and non-limiting examples of ultrasonic devices that may be employed in the processes and methods disclosed herein are described below.

As it pertains to an ultrasonic degassing process or to a process for removing impurities, the purging gas may be introduced into the molten metal bath, for instance, at a location near the ultrasonic device. In one embodiment, the purging gas may be introduced into the molten metal bath at a location near the tip of the ultrasonic device. In one embodiment, the purging gas may be introduced into the molten metal bath within about 1 meter of the tip of the ultrasonic device, such as, for example, within about 100 cm, within about 50 cm, within about 40 cm, within about 30 cm, within about 25 cm, or within about 20 cm, of the tip of the ultrasonic device. In some embodiments, the purging gas may be introduced into the molten metal bath within about 15 cm of the tip of the ultrasonic device; alternatively, within about 10 cm; alternatively, within about 8 cm; alternatively, within about 5 cm; alternatively, within about 3 cm; alternatively, within about 2 cm; or alternatively, within about 1 cm. In a particular embodiment, the purging gas may be introduced into the molten metal bath adjacent to or through the tip of the ultrasonic device.

While not intending to be bound by this theory, the use of an ultrasonic device and the incorporation of a purging gas in close proximity, results in a reduction in the amount of a dissolved gas in a bath containing molten metal. The ultrasonic energy produced by the ultrasonic device may create cavitation bubbles in the melt, into which the dissolved gas may diffuse. However, in the absence of the purging gas, many of the cavitation bubbles may collapse prior to reaching the surface of the bath of molten metal. The purging gas may lessen the amount of cavitation bubbles that collapse before reaching the surface, and/or may increase the size of the bubbles containing the dissolved gas, and/or may increase the number of bubbles in the molten metal bath, and/or may increase the rate of transport of bubbles containing dissolved gas to the surface of the molten metal bath. The ultrasonic device may create cavitation bubbles within close proximity to the tip of the ultrasonic device. For instance, for an ultrasonic device having a tip with a diameter of about 2 to 5 cm, the cavitation bubbles may be within about 15 cm, about 10 cm, about 5 cm, about 2 cm, or about 1 cm of the tip of the ultrasonic device before collapsing. If the purging gas is added at a distance that is too far from the tip of the ultrasonic device, the purging gas may not be able to diffuse into the cavitation bubbles. Hence, in embodiments related to ultrasonic degasification and ultrasonic grain refinement, the purging gas is introduced into the molten metal bath within about 25 cm or about 20 cm of the tip of the ultrasonic device, and more beneficially, within about 15 cm, within about 10 cm, within about 5 cm, within about 2 cm, or within about 1 cm, of the tip of the ultrasonic device.

Ultrasonic devices in accordance with embodiments of this invention may be in contact with molten metals such as aluminum or copper, for example, as disclosed in U.S. Patent Publication No. 2009/0224443, which is incorporated herein by reference in its entirety. In an ultrasonic device for reducing dissolved gas content (e.g., hydrogen) in a molten metal, niobium or an alloy thereof may be used as a protective barrier for the device when it is exposed to the molten metal, or as a component of the device with direct exposure to the molten metal.

Embodiments of the present invention related to ultrasonic degasification and ultrasonic grain refinement may provide systems and methods for increasing the life of components directly in contact with molten metals. For example, embodiments of the invention may use niobium to reduce degradation of materials in contact with molten metals, resulting in significant quality improvements in end products. In other words, embodiments of the invention may increase the life of or preserve materials or components in contact with molten metals by using niobium as a protective barrier. Niobium may have properties, for example its high melting point, that may help provide the aforementioned embodiments of the invention. In addition, niobium also may form a protective oxide barrier when exposed to temperatures of about 200° C. and above.

Moreover, embodiments of the invention related to ultrasonic degasification and ultrasonic grain refinement may provide systems and methods for increasing the life of components directly in contact or interfacing with molten metals. Because niobium has low reactivity with certain molten metals, using niobium may prevent a substrate material from degrading. Consequently, embodiments of the invention related to ultrasonic degasification and ultrasonic grain refinement may use niobium to reduce degradation of substrate materials resulting in significant quality improvements in end products. Accordingly, niobium in association with molten metals may combine niobium's high melting point and its low reactivity with molten metals, such as aluminum and/or copper.

In some embodiments, niobium or an alloy thereof may be used in an ultrasonic device comprising an ultrasonic transducer and an elongated probe. The elongated probe may comprise a first end and a second end, wherein the first end may be attached to the ultrasonic transducer and the second end may comprise a tip. In accordance with this embodiment, the tip of the elongated probe may comprise niobium (e.g., niobium or an alloy thereof). The ultrasonic device may be used in an ultrasonic degassing process, as discussed above. The ultrasonic transducer may generate ultrasonic waves, and the probe attached to the transducer may transmit the ultrasonic waves into a bath comprising a molten metal, such as aluminum, copper, zinc, steel, magnesium, and the like, or mixtures and/or combinations thereof (e.g., including various alloys of aluminum, copper, zinc, steel, magnesium, etc.).

In various embodiments of the invention, a combination of ultrasonic degassing and ultrasonic grain refinement is used. The use of the combination of ultrasonic degassing and ultrasonic grain refinement provides advantages both separately and in combination, as described below. While not limited to the following discussion, the following discussion provides an understanding of the unique effects accompanying a combination of the ultrasonic degassing and ultrasonic grain refinement, leading to improvement(s) in the overall quality of a cast product which would not be expected when either was used alone. These effects have been realized and by the inventors in their development of this combined ultrasonic processing.

In ultrasonic degassing, chlorine chemicals (utilized when ultrasonic degassing is not used) are eliminated from the metal casting process. When chlorine as a chemical is present in a molten metal bath, it can react and form strong chemical bonds with other foreign elements in the bath such as alkalis which might be present. When the alkalis are present, stable salts are formed in the molten metal bath, which could lead to inclusions in the cast metal product which deteriorates its electrical conductivity and mechanical properties. Without ultrasonic grain refinement, chemical grain refiners such as titanium boride are used, but these materials typically contain alkalis.

Accordingly, with ultrasonic degassing eliminating chlorine as a process element and with ultrasonic grain refinement eliminating grain refiners (a source of alkalis), the likelihood of stable salt formation and the resultant inclusion formation in the cast metal product is reduced substantially. Moreover, the elimination of these foreign elements as impurities improves the electrical conductivity of the cast metal product. Accordingly, in one embodiment of the invention, the combination of ultrasonic degassing and ultrasonic grain refinement means that the resultant cast product has superior mechanical and electrical conductivity properties, as two of the major sources of impurities are eliminated without substituting one foreign impurity for another.

Another advantage provided by the combination of ultrasonic degassing and ultrasonic grain refinement relates to the fact that both the ultrasonic degassing and ultrasonic grain refinement effectively "stir" the molten bath, homogenizing the molten material. When an alloy of the metal is being melted and then cooled to solidification, intermediate phases of the alloys can exist because of respective differences in the melting points of different alloy proportions. In one embodiment of the invention, both the ultrasonic degassing and ultrasonic grain refinement stir and mix the intermediate phases back into the molten phase.

All of these advantages permit one to obtain a product which is small-grained, having fewer impurities, fewer inclusions, better electrical conductivity, better ductility and higher tensile strength than would be expected when either ultrasonic degassing or ultrasonic grain refinement was used, or when either or both were replaced with conventional chlorine processing or chemical grain refiners were used.

Metal Products

In one aspect of the present invention, products including a cast metallic composition can be formed in a channel of a casting wheel or in the casting structures discussed above without the necessity of grain refiners and still having sub-millimeter grain sizes. Accordingly, the cast metallic compositions can be made with less than 5% of the compositions including the grain refiners and still obtain sub-millimeter grain sizes. The cast metallic compositions can be made with less than 2% of the compositions including the grain refiners and still obtain sub-millimeter grain sizes. The cast metallic compositions can be made with less than 1% of the compositions including the grain refiners and still obtain sub-millimeter grain sizes. In a preferred composition, the grain refiners are less than 0.5% or less than 0.2% or less than 0.1%. The cast metallic compositions can be made with the compositions including no grain refiners and still obtain sub-millimeter grain sizes.

The cast metallic compositions can have a variety of sub-millimeter grain sizes depending on a number of factors including the constituents of the "pure" or alloyed metal, the pour rates, the pour temperatures, the rate of cooling. The list of grain sizes available to the present invention includes the following. For aluminum and aluminum alloys, grain sizes range from 200 to 900 micron, or 300 to 800 micron, or 400 to 700 micron, or 500 to 600 micron. For copper and copper alloys, grain sizes range from 200 to 900 micron, or 300 to 800 micron, or 400 to 700 micron, or 500 to 600 micron. For gold, silver, or tin or alloys thereof, grain sizes range from 200 to 900 micron, or 300 to 800 micron, or 400 to 700 micron, or 500 to 600 micron. For magnesium or magnesium alloys, grain sizes range from 200 to 900 micron, or 300 to 800 micron, or 400 to 700 micron, or 500 to 600 micron. While given in ranges, the invention is capable of intermediate values as well. In one aspect of the present invention, small concentrations (less than 5%) of the grain refiners may be added to further reduce the grain size to values between 100 and 500 micron. The cast metallic compositions can include aluminum, copper, magnesium, zinc, lead, gold, silver, tin, bronze, brass, and alloys thereof.

The cast metallic compositions can be drawn or otherwise formed into bar stock, rod, stock, sheet stock, wires, billets, and pellets.

Computerized Control

Figure 12:
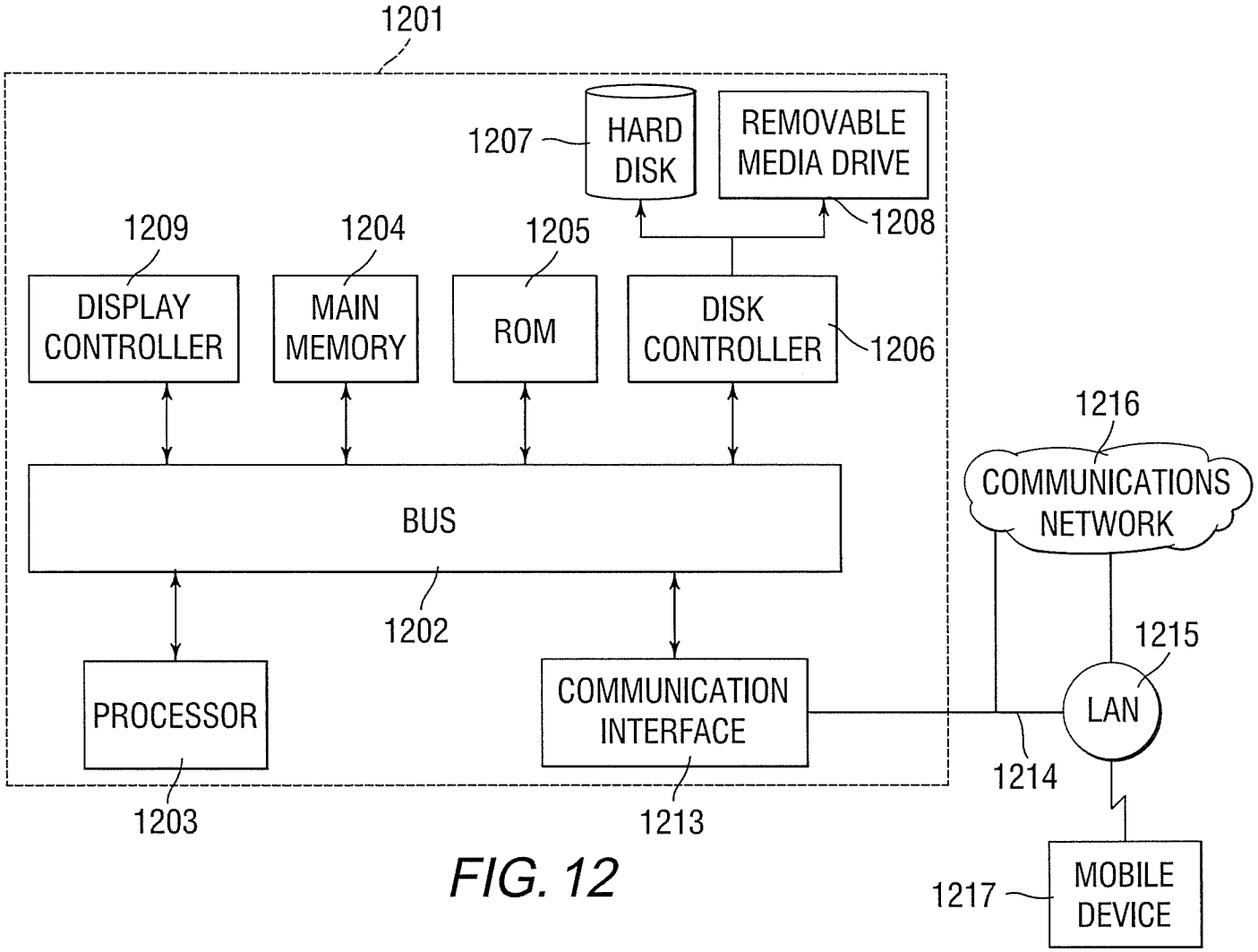
FIG. 12 is a schematic of an illustrative computer system for the controls and controllers depicted herein.

The controller 500 in FIG. 1 (for example) can be implemented by way of the computer system 1201 shown in FIG. 12. The computer system 1201 may be used as the controller 500 to control the casting systems noted above or any other casting system or apparatus employing the ultrasonic treatment of the present invention. While depicted singularly in FIG. 1 as one controller, controller 500 may include discrete and separate processors in communication with each other and/or dedicated to a specific control function.

Figure 13:
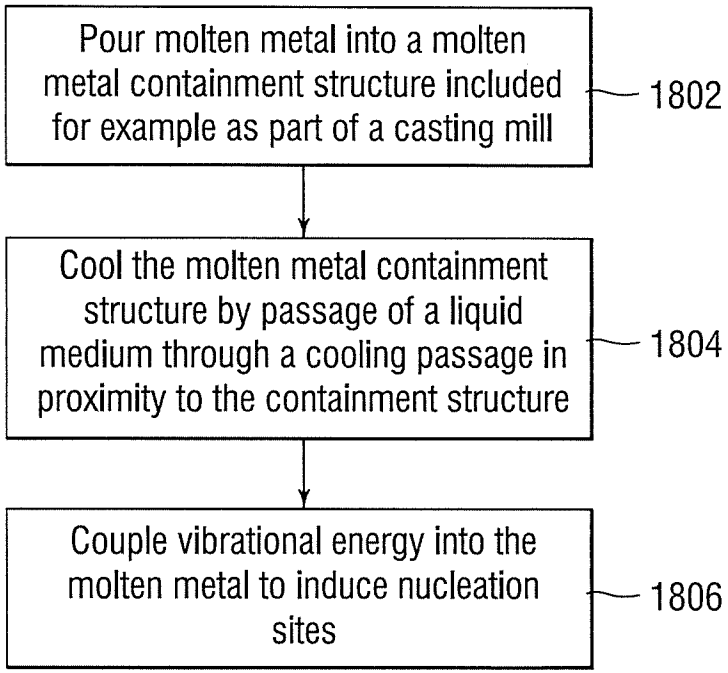
FIG. 13 is a flow chart depicting a method according to one embodiment of the invention.

In particular, the controller 500 can be programmed specifically with control algorithms carrying out the functions depicted by the flowchart in FIG. 13.

FIG. 13 depicts a flowchart whose elements can be programmed or stored in a computer readable medium or in one of the data storage devices discussed below. The flowchart of FIG. 13 depicts a method of the present invention for inducing nucleation sites in a metal product. At step element 1802, the programmed element would direct the operation of pouring molten metal, into a molten metal conveyor. At step element 1804, the programmed element would direct the operation of cooling the molten metal for example by control of the flow or passage of a liquid medium through a cooling channel in or attached to the conveyor. At step element 1806, the programmed element would direct the operation of coupling vibrational energy directly into a receptor plate in contact with the molten metal on the conveyor. In this element, the vibrational energy would have a frequency and power which induces nucleation sites in the molten metal, as discussed above. At step 1804, cooling of the molten metal could occur by control of a cooling medium flowing by the receptor plate as for example by control of vortex cooling blowing across the receptor plate.

Elements such as the molten metal temperature, pouring rate, cooling flow through the cooling channel passages, and mold cooling, and elements related to the control and draw of the cast product through the mill, including control of the power and frequency of the vibrational energy sources (for example the vibrational energy sources of molten metal conveyor 50), would be programmed with standard software languages (discussed below) to produce special purpose processors containing instructions to apply the method of the present invention for inducing nucleation sites in a metal product.

More specifically, computer system 1201 shown in FIG. 12 includes a bus 1202 or other communication mechanism for communicating information, and a processor 1203 coupled with the bus 1202 for processing the information. The computer system 1201 also includes a main memory 1204, such as a random access memory (RAM) or other dynamic storage device (e.g., dynamic RAM (DRAM), static RAM (SRAM), and synchronous DRAM (SDRAM)), coupled to the bus 1202 for storing information and instructions to be executed by processor 1203. In addition, the main memory 1204 may be used for storing temporary variables or other intermediate information during the execution of instructions by the processor 1203. The computer system 1201 further includes a read only memory (ROM) 1205 or other static storage device (e.g., programmable read only memory (PROM), erasable PROM (EPROM), and electrically erasable PROM (EEPROM)) coupled to the bus 1202 for storing static information and instructions for the processor 1203.

The computer system 1201 also includes a disk controller 1206 coupled to the bus 1202 to control one or more storage devices for storing information and instructions, such as a magnetic hard disk 1207, and a removable media drive 1208 (e.g., floppy disk drive, read-only compact disc drive, read/write compact disc drive, compact disc jukebox, tape drive, and removable magneto-optical drive). The storage devices may be added to the computer system 1201 using an appropriate device interface (e.g., small computer system interface (SCSI), integrated device electronics (IDE), enhanced-IDE (E-IDE), direct memory access (DMA), or ultra-DMA).

The computer system 1201 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)).

The computer system 1201 may also include a display controller 1209 coupled to the bus 1202 to control a display, such as a cathode ray tube (CRT) or liquid crystal display (LCD), for displaying information to a computer user. The computer system includes input devices, such as a keyboard and a pointing device, for interacting with a computer user (e.g. a user interfacing with controller 500) and providing information to the processor 1203.

The computer system 1201 performs a portion or all of the processing steps of the invention (such as for example those described in relation to providing vibrational energy to a liquid metal in a state of thermal arrest) in response to the processor 1203 executing one or more sequences of one or more instructions contained in a memory, such as the main memory 1204. Such instructions may be read into the main memory 1204 from another computer readable medium, such as a hard disk 1207 or a removable media drive 1208. One or more processors in a multi-processing arrangement may also be employed to execute the sequences of instructions contained in main memory 1204. In alternative embodiments, hard-wired circuitry may be used in place of or in combination with software instructions. Thus, embodiments are not limited to any specific combination of hardware circuitry and software.

The computer system 1201 includes at least one computer readable medium or memory for holding instructions programmed according to the teachings of the invention and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium, or other physical medium, a carrier wave (described below), or any other medium from which a computer can read.

Stored on any one or on a combination of computer readable media, the invention includes software for controlling the computer system 1201, for driving a device or devices for implementing the invention, and for enabling the computer system 1201 to interact with a human user. Such software may include, but is not limited to, device drivers, operating systems, development tools, and applications software. Such computer readable media further includes the computer program product of the invention for performing all or a portion (if processing is distributed) of the processing performed in implementing the invention.

The computer code devices of the invention may be any interpretable or executable code mechanism, including but not limited to scripts, interpretable programs, dynamic link libraries (DLLs), Java classes, and complete executable programs. Moreover, parts of the processing of the invention may be distributed for better performance, reliability, and/or cost.

The term "computer readable medium" as used herein refers to any medium that participates in providing instructions to the processor 1203 for execution. A computer readable medium may take many forms, including but not limited to, non-volatile media, volatile media, and transmission media. Non-volatile media includes, for example, optical, magnetic disks, and magneto-optical disks, such as the hard disk 1207 or the removable media drive 1208. Volatile media includes dynamic memory, such as the main memory 1204. Transmission media includes coaxial cables, copper wire and fiber optics, including the wires that make up the bus 1202. Transmission media may also take the form of acoustic or light waves, such as those generated during radio wave and infrared data communications.

The computer system 1201 can also include a communication interface 1213 coupled to the bus 1202. The communication interface 1213 provides a two-way data communication coupling to a network link 1214 that is connected to, for example, a local area network (LAN) 1215, or to another communications network 1216 such as the Internet. For example, the communication interface 1213 may be a network interface card to attach to any packet switched LAN. As another example, the communication interface 1213 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1213 sends and receives electrical, electromagnetic or optical signals that carry digital data streams representing various types of information.

The network link 1214 typically provides data communication through one or more networks to other data devices. For example, the network link 1214 may provide a connection to another computer through a local network 1215 (e.g., a LAN) or through equipment operated by a service provider, which provides communication services through a communications network 1216. In one embodiment, this capability permits the invention to have multiple of the above described controllers 500 networked together for purposes such as factory wide automation or quality control. The local network 1215 and the communications network 1216 use, for example, electrical, electromagnetic, or optical signals that carry digital data streams, and the associated physical layer (e.g., CAT 5 cable, coaxial cable, optical fiber, etc). The signals through the various networks and the signals on the network link 1214 and through the communication interface 1213, which carry the digital data to and from the computer system 1201 may be implemented in baseband signals, or carrier wave based signals. The baseband signals convey the digital data as unmodulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as unmodulated baseband data through a "wired" communication channel and/or sent within a predetermined frequency band, different than baseband, by modulating a carrier wave. The computer system 1201 can transmit and receive data, including program code, through the network(s) 1215 and 1216, the network link 1214, and the communication interface 1213. Moreover, the network link 1214 may provide a connection through a LAN 1215 to a mobile device 1217 such as a personal digital assistant (PDA) laptop computer, or cellular telephone.

More specifically, in one embodiment of the invention, a continuous casting and rolling system (CCRS) is provided which can produce pure electrical conductor grade aluminum rod and alloy conductor grade aluminum rod coils directly from molten metal on a continuous basis. The CCRS can use one or more of the computer systems 1201 (described above) to implement control, monitoring, and data storage.

In one embodiment of the invention, to promote yield of a high quality aluminum rod, an advanced computer monitoring and data acquisition (SCADA) system monitors and/or controls the rolling mill (i.e., the CCRS). Additional variables and parameters of this system can be displayed, charted, stored and analyzed for quality control.

In one embodiment of the invention, one or more of the following post production testing processes are captured in the data acquisition system.

Eddy current flaw detectors can be used in line to continuously monitor the surface quality of the aluminum rod. Inclusions, if located near the surface of the rod, can be detected since the matrix inclusion acts as a discontinuous defect. During the casting and rolling of aluminum rod, defects in the finished product can come from anywhere in the process. Incorrect melt chemistry and/or excessive hydrogen in the metal can cause flaws during the rolling process. The eddy current system is a non-destructive test, and the control system for the CCRS can alert the operator(s) to any one of the defects described above. The eddy current system can detect surface defects, and classify the defects as small, medium or large. The eddy current results can be recorded in the SCADA system and tracked to the lot of aluminum (or other metal being processed) and when it was produced.

Once the rod is coiled at the end of the process the bulk mechanical and electrical properties of cast aluminum can be measured and recorded in the SCADA system. Product quality tests include: tensile, elongation, and conductivity. The tensile strength is a measure of the strength of the materials and is the maximum force the material can withstand under tension before breaking. The elongation values are a measure of the ductility of the material. Conductivity measurements are generally reported as a percentage of the "international annealed copper standard" (IACS). These product quality metrics can be recorded in the SCADA system and tracked to the lot of aluminum and when it was produced.

In addition to eddy current data, surface analysis can be carried out using twist tests. The cast aluminum rod is subjected to a controlled torsion test. Defects associated with improper solidification, inclusions and longitudinal defects created during the rolling process are magnified and revealed on the twisted rod. Generally, these defects manifest in the form of a seam that is parallel to the rolling the direction. A series of parallel lines after the rod is twisted clockwise and counterclockwise indicates that the sample is homogeneous, while non-homogeneities in the casting process will result in fluctuating lines. The results of the twist tests can be recorded in the SCADA system and tracked to the lot of aluminum and when it was produced.

Sample and Product Preparation

The samples and products can be made with the CCR system noted above utilizing the enhanced vibrational energy coupling and/or enhanced cooling techniques detailed above. The casting and rolling process starts as a continuous stream of molten aluminum from a system of melting and holding furnaces, delivered through a refractory lined launder system to either an in-line chemical grain refining system or the ultrasonic grain refinement system discussed above. Additionally, the CCR system can include the ultrasonic degassing system discussed above which uses ultrasonic acoustic waves and a purge gas in order to remove dissolved hydrogen or other gases from the molten aluminum. From the degasser, the metal would flow to a molten metal filter with porous ceramic elements which further reduce inclusions in the molten metal. The launder system would then transport the molten aluminum to the tundish. From the tundish, the molten aluminum would be poured into a mold formed by the peripheral groove of a copper casting ring and a steel band, as discussed above. Molten aluminum would be cooled to a solid cast bar by water distributed through spray nozzles from multi-zone water manifolds with magnetic flow meters for critical zones. The continuous aluminum cast bar exits the casting ring onto a bar extraction conveyor to a rolling mill.

The rolling mill can include individually driven rolling stands that reduce the diameter of the bar. The rod would be sent to a drawing mill where the rods would be drawn to predetermined diameters, and then coiled. Once the rod was coiled at the end of the process the bulk mechanical and electrical properties of cast aluminum would be measured. The quality tests include: tensile, elongation, and conductivity. The Tensile strength is a measure of the strength of the materials and is the maximum force the material can withstand under tension before breaking. The elongation values are a measure of the ductility of the material. Conductivity measurements are generally reported as a percentage of the "international annealed copper standard" (IACS).)

1) The Tensile strength is a measure of the strength of the materials and is the maximum force the material can withstand under tension before breaking. The tensile and elongation measurements were carried out on the same sample. A 10" gage length sample was selected for tensile and elongation measurements. The rod sample was inserted into the tensile machine. The grips were placed at 10" gauge marks. Tensile Strength=Breaking Force (pounds)/Cross sectional area ($\pi r^2$) where r (inches) is the radius of the rod.

2) % Elongation=$((L_1-L_2)/L_1)\times 100$. $L_1$ is the initial gage length of the material and $L_2$ is the final length that is obtained by placing the two broken samples from the tension test together and measuring the failure that occurs. Generally, the more ductile the material the more neck down will be observed in the sample in tension.

3) Conductivity: Conductivity measurements are generally reported as a percentage of the "international annealed copper standard" (IACS). Conductivity measurements are carried out using Kelvin Bridge and details are provided in ASTM B193-02. IACS is a unit of electrical conductivity for metals and alloys relative to a standard annealed copper conductor; an IACS value of 100% refers to a conductivity of 5.80×107 siemens per meter (58.0 MS/m) at 20° C.

The continuous rod process as described above could be used to produce not only electrical grade aluminum conductors, but also can be used for mechanical aluminum alloys utilizing the ultrasonic grain refining and ultrasonic degassing. For testing and quality control, the ultrasonic grain refining process, cast bar samples would be collected and etched.

Figure 14:
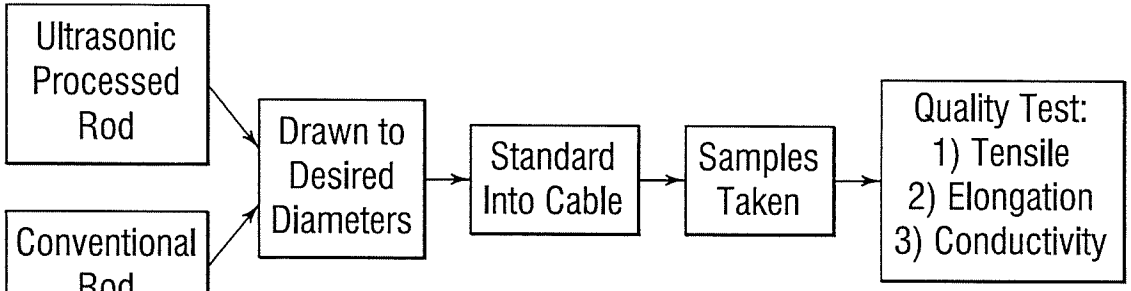
FIG. 14 is an ACSR wire process flow diagram.

FIG. 14 is an ACSR wire process flow diagram. It shows the conversion of pure molten aluminum into aluminum wire that will be used in ACSR wire. The first step in the conversion process is to convert the molten aluminum into aluminum rod. In the next step the rod is drawn through several dies and depending on the end diameter this may be accomplished through one or multiple draws. Once the rod is drawn to final diameters the wire is spooled onto reels of weights ranging between 200 and 500 lbs. These individual reels would be stranded around a steel stranded cable into ACSR cables that contains several individual aluminum strands. The number of strands and the diameter of each strand will depend on for example on customer requirements.

Figure 15:
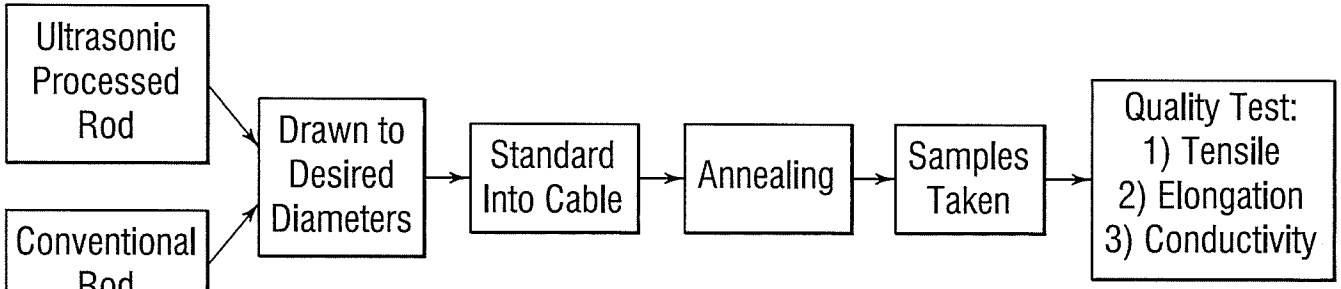
FIG. 15 is an ACSS wire process flow diagram.

FIG. 15 is an ACSS wire process flow diagram. It shows the conversion of pure molten aluminum into aluminum wire that will be used in ACSS wire. The first step in the conversion process is to process the molten aluminum into aluminum rod. In the next step, the rod is drawn through several dies and depending on the end diameter this may be accomplished through one or multiple draws. Once the rod is drawn to final diameters the wire is spooled onto reels of weights ranging between 200 and 500 lbs. These individual reels would be stranded around a steel stranded cable into ACSS cables that contains several individual aluminum strands. The number of strands and the diameter of each strand will depend on the customer requirements. One difference between the ACSR and ACSS cable is that, once the aluminum is stranded around the steel cable, the whole cable is heat treated in furnaces to bring the aluminum to a dead soft condition. It is important to note that in ACSR the strength of the cable is derived from the combination of the strengths due to the aluminum and steel cable while in the ACSS cable most of the strength comes from the steel inside the ACSS cable.

Figure 16:
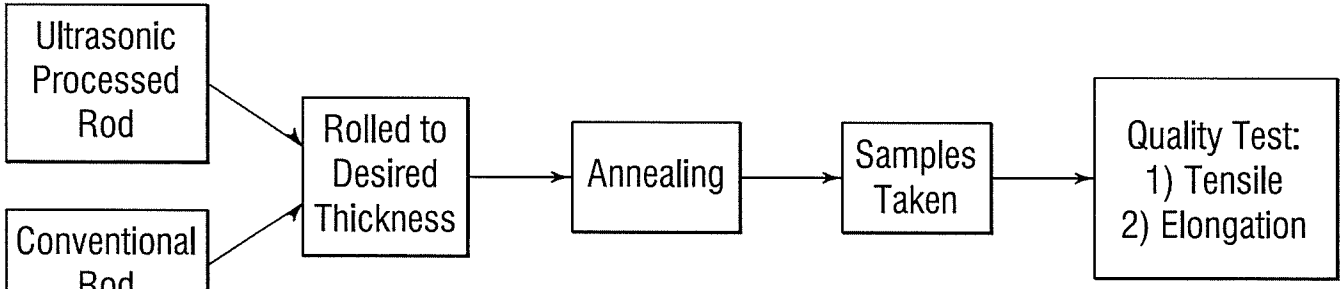
FIG. 16 is an aluminum strip process flow diagram.

FIG. 16 is an aluminum strip process flow diagram, where the strip is finally processed into metal clad cable. It shows that the first step is to convert the molten aluminum into aluminum rod. Following this the rod is rolled through several rolling dies to convert it into strip, generally of about 0.375" in width and about 0.015 to 0.018" thickness. The rolled strip is processed into donut shaped pads that weigh approximately 600 lbs. It is important to note that other widths and thicknesses can also be produced using the rolling process, but the 0.375" width and 0.015 to 0.018" thickness are the most common. These pads are then heat treated in furnaces to bring the pads to an intermediate anneal condition. In this condition, the aluminum is neither fully hard nor in a dead soft condition. The strip would then be used as a protective jacket assembled as an armor of interlocking metal tape (strip) that encloses one or more insulated circuit conductors.

The ultrasonic grain refined materials of this invention utilizing the direct vibrational energy coupling described above can be fabricated into the above-noted wire and cable products, using the processes described above.

Generalized Statements of the Invention

The following statements of the invention provide one or more characterizations of the present invention and do not limit the scope of the present invention.

Statement 1. A molten metal conveying device (i.e., a conveyor), comprising: a receptor plate in contact with molten metal, at least one vibrational energy source which supplies (e.g., which has a configuration which supplies) vibrational energy (e.g., ultrasonic, mechanically-driven, and/or acoustic energy) directly to the receptor plate in contact with molten metal, optionally while the molten metal is cooled. The receptor plate extends from an entrance where molten metal enters onto the receptor plate to an exit where molten metal exits the receptor plate.

Statement 2. The device of statement 1, wherein the receptor plate has at least one channel for passage of cooling medium. Statement 3. The conveyor of statement 2, wherein said cooling medium comprises at least one of water, gas, liquid metal, liquid nitrogen, and engine oil. Statement 4. The conveyor of statement 2, wherein said cooling channel is within the receptor plate or said cooling channel comprises a conduit attached to the receptor plate. Statement 5. The conveyor of statement 1, further comprising a blower providing gas flow to cool the receptor plate.

Statement 6. The conveyor of statement 1, further comprising an assembly which mounts said receptor plate in relationship to a casting wheel of a casting mill or to a tundish supplying molten metal to a mold.

Statement 7. The conveyor of statement 1, wherein at least one vibrational energy source comprises at least one of an ultrasonic transducer, a magnetostrictive transducer, and a mechanically driven vibrator providing vibrational energy directly to the receptor plate in contact with molten metal. Statement 8. The conveyor of statement 1, wherein the vibration energy provided to said receptor plate is in a range of frequencies up to 400 kHz.

Statement 9. The conveyor of statement 1, wherein the receptor plate has at least one of a smooth finish, a polished finish, a rough finish, a raised finish, a textured finish, and an indented finish. Statement 10. The conveyor of statement 1, wherein the receptor plate comprises at least one or more of niobium, a niobium alloy, titanium, a titanium alloy, tantalum, a tantalum alloy, copper, a copper alloy, rhenium, a rhenium alloy, steel, molybdenum, a molybdenum alloy, stainless steel, a ceramic, a composite, or a metal. Statement 11. The conveyor of statement 10, wherein the ceramic comprises a silicon nitride ceramic. Statement 12. The conveyor of statement 11, wherein the silicon nitride ceramic comprises a silica alumina nitride.

Statement 13. The conveyor of statement 1, wherein the at least one vibrational energy source comprises a plurality of transducers arranged in an ordered pattern on the receptor plate. Statement 14. The conveyor of statement 13, wherein the ordered pattern on the receptor plate has a higher density of said transducers on one side of the receptor plate. Statement 15. The conveyor of statement 14, wherein the higher density of said transducers on one side of the receptor plate is on a molten metal exit side. Statement 16. The conveyor of statement 14, wherein the higher density of said transducers on one side of the receptor plate is on a molten metal entrance side.

Statement 17. The conveyor of statement 1, wherein the at least one vibrational energy source comprises a piezoelectric transducer element attached to the receptor plate. Statement 18. The conveyor of statement 17, an ultrasonic booster coupled to the piezoelectric transducer element attached to the receptor plate. Statement 19. The conveyor of statement 1, wherein the at least one vibrational energy source comprises a magnetostrictive transducer element attached to the receptor plate. Statement 20. The conveyor of statement 1, further comprising an ultrasonic degasser inserted in a molten metal flow channel.

Statement 21. The conveyor of statement 1, wherein the receptor plate has a thickness of less than 10 cm. Statement 22. The conveyor of statement 1, wherein the receptor plate has a thickness between 0.5 cm and 5 cm, or between 1 cm and 3 cm. Statement 23. The conveyor of statement 1, wherein the receptor plate has a thickness between 1.5 cm and 2 cm. Statement 24. The conveyor of statement 1, wherein the receptor plate has different thicknesses in different sections.

Statement 25. The conveyor of statement 1, wherein the receptor plate is disposed above a casting wheel and provides the molten metal to a trough in the casting wheel. Statement 26. The conveyor of statement 1, wherein the receptor plate is attached to a vertical mold and provides the molten metal to an interior of the vertical mold.

Statement 27. The conveyor of statement 1, wherein the receptor plate comprises a lateral width equal to or less than a longitudinal length, or the lateral width equal to or less than a half of the longitudinal length; or the lateral width equal to or less than a third of the longitudinal length. Statement 28. The conveyor of statement 1, wherein the receptor plate comprises a lateral width between 2.5 cm and 300 cm. Statement 29. The conveyor of statement 1, wherein the receptor plate comprises a lateral width which tapers down in width toward the exit.

Statement 30. The conveyor of statement 1, wherein the receptor plate is disposed in a near horizontal orientation with gravity forcing the molten metal to the exit. Statement 31. The conveyor of statement 1, wherein the receptor plate is disposed within or equal to 45 angular degrees from a horizontal orientation with gravity forcing the molten metal to the exit. Statement 32. The conveyor of statement 1, wherein the receptor plate is disposed within or equal to 45 angular degrees from a vertical orientation.

Statement 33. The conveyor of statement 1, further comprising a controller controlling at least one of a pour rate of the molten metal onto the receptor plate and a cooling rate of the molten metal on the receptor plate. Statement 34. The conveyor of statement 33, wherein the controller is programmed to adjust the pour rate such that a height of the molten metal above the receptor plate is between 1.25 cm and 10 cm.

Statement 35. A method for forming a metal product, comprising: providing molten metal onto a molten conveyor which transports the molten metal along a receptor plate of the conveyor in contact with the molten metal; cooling the molten metal by control of a cooling medium flowing by the receptor plate or through a cooling passage in or attached to the receptor plate; and coupling vibrational energy directly into the receptor plate.

Statement 36. The method of statement 35, wherein coupling energy comprises supplying said energy from at least one of an ultrasonic transducer or a magnetostrictive transducer or a mechanically-driven vibrator to said probe. Statement 37. The method of statement 36, wherein supplying said energy comprises providing the energy in a range of frequencies from 5 and 400 kHz. Statement 38. The method of statement 35, wherein cooling comprises cooling the molten metal by application of at least one of water, gas, liquid metal, liquid nitrogen, and engine oil as a coolant of the receptor plate.

Statement 39. The method of statement 35, wherein providing molten metal comprises pouring the molten metal from a pouring device of a casting wheel onto the receptor plate. Statement 40. The method of statement 39, further comprising pouring the molten metal from the receptor plate into a trough of the casting wheel. Statement 41. The method of statement 35, wherein providing molten metal comprises pouring the molten metal from a tundish of a vertical mold onto the receptor plate. Statement 42. The method of statement 41, further comprising pouring the molten metal from the receptor plate into the vertical mold. Statement 43. The method of statement 35, further comprising pouring the molten metal from the receptor plate into a continuous casting mold. Statement 44. The method of statement 35, further comprising pouring the molten metal from the receptor plate into a horizontal or vertical casting mold.

Statement 45. A casting mill comprising: a casting mold configured to cool molten metal, and the conveyor of any one of statement s 1-34. Statement 46. The mill of statement 45, wherein the mold comprises a continuous casting mold. Statement 47. The mill of statement 45, wherein the mold comprises a horizontal or vertical casting mold.

Statement 48. A system for forming a metal product, comprising: means for providing molten metal onto a molten conveyor; means for controlling a cooling medium flowing through a cooling passage in or attached to a receptor plate of the conveyor in contact with the molten metal; means for coupling vibrational energy directly into the receptor plate; and a controller including data inputs and control outputs, and programmed with control algorithms which permit operation of any one of the step elements recited in statements 35-44.

Statement 49. A system for forming a metal product, comprising: the conveyor of any one of the statements 1-34; and a controller including data inputs and control outputs, and programmed with control algorithms which permit operation of any one of the step elements recited in statements 35-44.

Statement 50. A system for forming a metal product, comprising: a pouring device for pouring molten metal; a casting wheel for forming a continuous casting of the metal product; and an assembly coupling the conveyor of any one of the statements 1-34 to the casting wheel; and a controller including data inputs and control outputs, and programmed with control algorithms which permit operation of any one of the step elements recited in statements 35-44.

Numerous modifications and variations of the present invention are possible in light of the above teachings. It is therefore to be understood that within the scope of the appended claims, the invention may be practiced otherwise than as specifically described herein.

The invention claimed is:

1. A molten metal conveyor comprising:

a receptor plate in contact with molten metal during transport of the molten metal;

said receptor plate extending from an entrance where molten metal enters onto the receptor plate to an exit where molten metal exits the receptor plate; and at least one vibrational energy source which supplies vibrational energy directly to the receptor plate in contact with molten metal;

wherein the at least one vibrational energy source comprises a plurality of transducers arranged in an ordered pattern on the receptor plate having a higher density of said transducers at an outlet of the receptor plate.

2. The conveyor of claim 1, wherein said receptor plate comprises a cooling channel for passage of a cooling medium.

3. The conveyor of claim 2, wherein said cooling medium comprises at least one of water, gas, liquid metal, liquid nitrogen, and engine oil.

4. The conveyor of claim 2, wherein said cooling channel is within the receptor plate or said cooling channel comprises a conduit attached to the receptor plate.

5. The conveyor of claim 1, further comprising a blower providing gas flow to cool the receptor plate.

6. The conveyor of claim 1, further comprising an assembly which mounts said receptor plate in relationship to a casting wheel of a casting mill or to a tundish supplying molten metal to a mold.

7. The conveyor of claim 1, wherein at least one vibrational energy source comprises at least one of an ultrasonic transducer, a magnetostrictive transducer, and a mechanically driven vibrator providing vibrational energy directly to the receptor plate in contact with molten metal.

8. The conveyor of claim 1, wherein the vibration energy provided to said receptor plate is in a range of frequencies up to 400 kHz.

9. The conveyor of claim 1, wherein the receptor plate comprises at least one or more of niobium, a niobium alloy, titanium, a titanium alloy, tantalum, a tantalum alloy, copper, a copper alloy, rhenium, a rhenium alloy, steel, molybdenum, a molybdenum alloy, stainless steel, a ceramic, a composite, or a metal.

10. The conveyor of claim 1, wherein the at least one vibrational energy source comprises a piezoelectric transducer element attached to the receptor plate.

11. The conveyor of claim 10, an ultrasonic booster coupled to the piezoelectric transducer element attached to the receptor plate.

12. The conveyor of claim 1, wherein the at least one vibrational
energy source comprises a magnetostrictive transducer element attached to the receptor plate.

13. The conveyor of claim 1, further comprising an ultrasonic degasser inserted in a molten metal flow channel.

14. The conveyor of claim 1, wherein the receptor plate has a thickness between 1.5 cm and 2 cm.

15. The conveyor of claim 1, wherein the receptor plate is disposed above a casting wheel and provides the molten metal to a trough in the casting wheel.

16. The conveyor of claim 1, wherein the receptor plate comprises a lateral width between 2.5 cm and 300 cm.

17. A casting mill comprising:

a casting mold configured to cool molten metal, and the conveyor of claim 1.

* * * * *